US005822991A

United States Patent [19]

Pierzchala et al.

[11] Patent Number: 5,822,991

[45] Date of Patent: Oct. 20, 1998

[54] CIRCULATING FLUIDIZED BED STEAM GENERATOR (CFB) WITH A SUPERHEATER AND A REHEATER

[75] Inventors: Stephen A. Pierzchala, East Longmeadow, Mass.; Bruce W. Wilhelm, Enfield, Conn.

[73] Assignee: Combustion Engineering, Inc., Windsor, Conn.

[21] Appl. No.: 801,714

[22] Filed: Feb. 14, 1997

[51] Int. Cl.[6] ..... F01K 7/34

[52] U.S. Cl. ..... 60/653; 122/4 D

[58] Field of Search ..... 60/653, 679; 122/4 D

[56] References Cited

U.S. PATENT DOCUMENTS 5,442,919 8/1995 Wilhelm ..... 60/653

*Primary Examiner*—Noah P. Kamen

*Attorney, Agent, or Firm*—Arthur E. Fournier, Jr.

[57] ABSTRACT

A method for exercising control over the final predefined superheat outlet steam temperature and for exercising control over the final predefined reheat outlet steam temperature from a circulating fluidized bed steam generator having a furnace volume embodying at least superheat surface, a multichambered backpass volume embodying at least superheat surface within one chamber of the multichambered backpass volume and at least reheat surface within another one of the multichambered backpass volume, a first circulatory fluid flow path operative as an evaporative steam loop, and a second circulatory fluid flow path operative as a superheat steam-reheat steam loop and including a saturated steam segment, a superheat steam segment, a reheat steam segment and an economizer segment.

21 Claims, 7 Drawing Sheets

CIRCULATING FLUIDIZED BED STEAM GENERATOR (CFB) WITH A SUPERHEATER AND A REHEATER

BACKGROUND OF THE INVENTION

This invention relates to fossil fuel-fired circulating fluidized bed steam generators (CFB), and more specifically to a method for controlling the final superheat outlet steam temperature from a circulating fluidized bed steam generator (CFB) as well as the final reheat outlet steam temperature from a circulating fluidized bed steam generator (CFB).

It has been known heretofore in the prior art to provide fluidized bed steam generators of various types. In this regard, one convenient method of differentiating between such various types of fluidized bed steam generators is by the nature of the fluidization that takes place therewithin. As employed in this context, the term "fluidization" refers to the manner in which solid materials are provided with a free-flowing, fluid-like behavior. To this end, as a gas is made to pass upwardly in a fluidized bed steam generator through a bed of solid particles that is present therewithin, such a flow of gases produces forces that tend to separate the solid particles one from another. At low gas velocities such forces can be insufficient to cause the solid particles to separate one from another such that the solid particles remain in contact with one another, i.e., tend to resist movement therebetween. When such a condition exists, it is referred to as being a fixed bed. As such, fluidized bed steam generators in which such a condition exists are commonly referred to in the art as being fixed bed fluidized bed steam generators.

On the other hand, as the gas velocity is increased, a point is reached wherein the gas velocity is sufficient such that the forces acting upon the solid particles are adequate to cause separation of the solid particles. When this occurs, the bed of solid particles then become fluidized in that the gas cushion between the solid particles permit the solid particles to move freely, thus giving the bed of solid particles liquid-like characteristics.

The design of fluidized bed steam generators is generally such that for purposes of the combustion process that takes place therewithin, fuel is burned in a bed of hot incombustible particles, the latter particles being suspended by an upwardly flow of fluidizing gas. Moreover, this fluidizing gas normally is comprised of both air, which is being supplied to the fluidized bed steam generator to support the combustion of fuel therewithin, and the gaseous byproducts, which result from such combustion of fuel and air.

Fluidized bed steam generators, including but not limited to circulating fluidized bed steam generators (CFB), are normally intended to be operative to produce steam. Moreover, such production of steam results from the combustion of fuel and air within the fluidized bed steam generators. Furthermore, the steam that is so produced within the fluidized bed steam generator is designed to be operative to function in accordance with a preselected thermodynamic steam cycle. It should thus be readily apparent from the preceding that the production of steam from a circulating fluidized bed steam generator (CFB) involves both a combustion process and a thermodynamic steam cycle.

Inasmuch as the subject matter of the instant application relates in particular to circulating fluidized bed steam generators (CFB), the discussion hereinafter will be presented in the context of a circulating fluidized bed steam generator (CFB). To this end, a circulating fluidized bed steam generator (CFB) includes a furnace volume, the walls of which are comprised of vertical waterwall tubes. In the lower segment of the furnace volume, fuel and sorbent are mixed with and burned in air, producing hot combustion gases in which hot solids become entrained. These hot combustion gases with the hot solids entrained therewith rise within the furnace volume. In the course of doing so, the suspension density of the hot solids entrained in the hot combustion gases diminishes with the increasing height of the furnace volume.

Continuing, as these hot combustion gases and hot solids entrained therewith rise within the furnace volume, heat is transferred to the aforementioned waterwall tubes thereby causing saturated steam to be evaporatively produced in conventional fashion from the water rising within the waterwall tubes. This saturated steam is a mix of steam and water, which is thereafter separated in known fashion in a steam drum. From the steam drum, the water is returned to the waterwall tubes in the lower segment of the furnace volume thereby completing an evaporative loop, while the steam is delivered to a superheater to which further reference will be had hereinafter.

From the top of the furnace volume, the hot combustion gases and hot solids entrained therewith are directed to a cyclone where unburned fuel, flyash and sorbent above a predetermined size are mechanically separated from the hot combustion gases. This unburned fuel, flyash and sorbent are collected from the cyclone, then are made to fall under the influence of gravity through a stand pipe and a seal pot, and are thereafter reintroduced into the lower segment of the furnace volume whereupon this unburned fuel, flyash and sorbent are once again subjected to the combustion process. The foregoing describes the circulation path followed by the hot solids, which are above a predetermined size, that become entrained with the hot combustion gases.

The hot combustion gases entering the cyclone, which hereinafter will be referred to as flue gases, still contain useful energy, and after separation therefrom of unburned fuel, flyash and sorbent above a predetermined size, are directed to a backpass, with which the circulating fluidized bed steam generator (CFB) is suitably provided, wherein additional heat exchange surfaces are located. These additional heat exchange surfaces commonly comprise superheat surface followed by possibly reheat surface and thereafter economizer surface. The superheat surface in known fashion is operative to heat, i.e., superheat, the steam, which as described hereinbefore has been separated from the water in the steam drum of the circulating fluidized bed steam generator (CFB), whereupon this steam, which has been subjected to superheating, is made to flow to a high pressure turbine (HPT). After expansion in the high pressure turbine (HPT), the aforementioned steam, which has been subjected to superheating, is made to flow to the reheat surface, if such reheat surface has been provided in the backpass of the circulating fluidized bed steam generator (CFB). The reheat surface is operative in known fashion to once again heat, i.e., reheat, the steam, which as described hereinbefore has been separated from the water in the steam drum of the circulating fluidized bed steam generator (CFB), whereupon this steam, which has been subjected to reheating, is made to flow to a low pressure turbine (LPT).

Continuing, after further expansion in the low pressure turbine (LPT), the aforereferenced steam, which has been subjected to reheating, is condensed to water, whereupon the water that results from condensing of the reheated steam is made to flow to the economizer surface, which is located in the backpass of the circulating fluidized bed steam generator (CFB). The foregoing completes the description of the thermodynamic steam cycle of the steam, which is produced from the combustion process that takes place within the circulating fluidized bed steam generator (CFB). In closing, however, note is made herein of the fact that at appropriate points relative to the superheat surface and to the reheat surface, which are located in the backpass of the circulating fluidized bed steam generator (CFB), water spray stations are provided that are used to control the temperature of the superheat steam, which flows to the high pressure turbine (HPT), and/or to control the temperature of the reheat steam, which flows to the low pressure turbine (LPT). The water, which is employed in these water spray stations, is extracted from the water, which is produced from the condensing of the reheat steam, that is made to flow to the economizer surface located in the backpass of the circulating fluidized bed steam generator, and as such the water, which is employed in these water spray stations, is, therefore, not available for use in generating steam.

The flue gases during the passage thereof through the backpass of the circulating fluidized bed steam generator (CFB) are cooled as a consequence of the heat exchange that occurs between the flue gases and the superheat surface, the reheat surface (if present), and the economizer surface, which are located in the backpass of the circulating fluidized bed steam generator (CFB). Upon exiting from the backpass of the circulating fluidized bed steam generator (CFB), the now cooler flue gases are then preferably utilized in known fashion to effect therewith a preheating of the air, which is supplied to the circulating fluidized bed steam generator (CFB) for the purpose of accomplishing therewith the combustion of fuel within the circulating fluidized bed steam generator (CFB). Thereafter, the flue gases also in known fashion are generally made to flow to and through a particulate removal system for purposes of effecting the removal of particulates from the flue gases after which the flue gases are emitted to the atmosphere from a stack, which is cooperatively associated with the circulating fluidized bed steam generator (CFB). The foregoing completes the description of the path of flow of the flue gases, the latter being generated from the combustion of fuel and air within the circulating fluidized bed steam generator (CFB).

Sometimes one or more fluidized bed heat exchangers (FBHE) are provided in the circulation path of the hot solids, which are produced from the combustion of fuel and air within the furnace volume of the circulating fluidized bed steam generator (CFB). By way of background, the term fluidized bed heat exchanger (FBHE) as employed herein is intended to refer to a closed compartment, which is thermally isolated from its surroundings and which is designed to be operative to enable heat to be exchanged therewithin between a hot medium and a cool medium. In the present instance, the hot medium comprises the hot solids, which are produced during operation of the circulating fluidized bed steam generator (CFB), and the cool medium comprises the steam or water of the thermodynamic steam cycle of the circulating fluidized bed steam generator (CFB). When such fluidized bed heat exchangers (FBHE) are so provided, a portion of the hot solids, which are produced during operation of the circulating fluidized bed steam generator (CFB) are diverted to and made to flow through the fluidized bed heat exchangers (FBHE) before the hot solids, which have been diverted, are reintroduced into the furnace volume of the circulating fluidized bed steam generator (CFB).

The aforementioned fluidized bed heat exchangers (FBHE) as such are capable of being employed to perform therewithin some portion of the duty of the thermodynamic steam cycle of the circulating fluidized bed steam generator (CFB). By way of exemplification and not limitation in this regard, one such fluidized bed heat exchanger (FBHE) may embody superheat surface whereby superheat steam may be made to pass through this fluidized bed heat exchanger (FBHBE) for purposes of enabling there to be accomplished therewithin final superheat of this superheat steam before such superheat steam flows to the high pressure turbine (HPT) and/or another one of such fluidized bed heat exchangers (FBHE) may embody reheat surface whereby reheat steam may be made to pass through this fluidized bed heat exchanger (FBHE) for purposes of enabling there to be accomplished therewithin final reheat of this reheat steam before such reheat steam flows to the low pressure turbine (LPT). In addition to embodying superheat surface or reheat surface, each such one of these fluidized bed heat exchangers (FBHE) may also embody evaporative surface. Such evaporative surface, which would be connected in fluid flow relation with the waterwall tubes of the furnace volume, preferably would be provided in the aforereferenced fluidized bed heat exchangers (FBHE) downstream of the superheat surface or the reheat surface, as the case may be, which is also provided therewithin.

Methods and/or means relating to superheaters and/or reheaters have been known in the prior art heretofore. By way of exemplification and not limitation in this regard, one such method and/or means is that to which U.S. Pat. No. 4,336,769, which issued on Jun. 29, 1982, is directed. In accordance with the teachings of U.S. Pat. No. 4,336,769, a heat recovery area is provided adjacent the upper furnace section in gas flow communication therewith and includes a vestibule section and a convection section. The convection section includes a front wall, a rear wall and two sidewalls. The rear wall, the sidewalls and the lower portions of the front wall are formed of a plurality of vertically extending, finned, interconnected tubes in a similar fashion to that of the furnace section, and slots or openings are provided in the upper portion of the front wall to permit communication between the vestibule section and the convection section. A partition wall, also formed by a plurality of finned interconnected tubes, is provided in the convection section to divide the latter into a front gas pass and a rear gas pass. An economizer is disposed in the lower portion of the rear gas pass, a primary superheater is disposed immediately above the economizer, and a bank of reheater tubes is provided in the front gas pass. A platen superheater is provided in the upper furnace section and a finishing superheater is provided in the vestibule section in direct fluid communication with the platen superheater.

By way of exemplification and not limitation, another such method and/or means is that to which U.S. Pat. No. 5,054,436, which issued on Oct. 8, 1991, is directed. In accordance with the teachings of U.S. Pat. No. 5,054,436, there is provided a heat recovery section. This heat recovery section includes an enclosure divided by a vertical partition into a first passage, which houses a reheater, and a second passage, which houses a primary superheater and an upper economizer, all of which are formed by a plurality of heat exchange tubes extending in the path of the gases from the separator as they pass through the enclosure. An opening is provided in the upper portion of the partition to permit a portion of the gases to flow into the passage containing the superheater and the upper economizer. After passing across the reheater, superheater and the economizer in the two parallel passes, the gases pass through a lower economizer before exiting the enclosure through an outlet formed in the rear wall thereof.

By way of exemplification and not limitation, yet another such method and/or means is that to which U.S. Pat. No.

5,069,170, which issued on Dec. 3, 1991, is directed. In accordance with the teachings of U.S. Pat. No. 5,069,170, there is provided a heat recovery section. The heat recovery section includes an enclosure divided by a vertical partition into a first passage, which houses a reheater, and a second passage, which houses a primary superheater and an economizer, all of which are formed by a plurality of heat exchange tubes extending in the path of the gases from the separator as they pass through the enclosure. An opening is provided in the upper portion of the partition to permit a portion of the gases to flow into the passage containing the superheater and the economizer. After passing across the reheater, superheater and the economizer in the two parallel passes, the gases exit the enclosure through an outlet.

Although the aforereferenced prior art methods and/or means relating to superheaters and reheaters are alleged to be operative for their intended purpose, nevertheless there still exists a need for a new and improved method for controlling the final superheat outlet steam temperature from a circulating fluidized bed steam generator (CFB) as well as the final reheat outlet steam temperature from a circulating fluidized bed steam generator (CFB). To this end, it is essential insofar as the life of the high pressure turbine and the low pressure turbine, which are cooperatively associated with a circulating fluidized bed steam generator (CFB), is concerned that the steam supplied to these turbines be properly controlled. Likewise, it is essential insofar as ensuring the realization of the thermodynamic steam cycle desired for the circulating fluidized bed steam generator (CFB) is concerned that the steam, which is generated pursuant to the desired thermodynamic steam cycle, be properly controlled. Typically, control over such steam is effected through the use of spray desuperheaters, which are strategically located within the thermodynamic steam cycle of the circulating fluidized bed steam generator (CFB). However, in the case of circulating fluidized bed steam generators (CFB) that are equipped with fluidized bed heat exchangers, control of such steam is commonly effected by means of a feedback control system operatively associated with the fluidized bed heat exchangers.

In particular, there has been shown to exist a need for such a new and improved method for controlling the final superheat outlet steam temperature as well as the final reheat outlet steam temperature of a circulating fluidized bed steam generator (CFB) wherein such control thereover can be effected with the fluid circuitry of the thermodynamic steam cycle of the circulating fluidized bed steam generator (CFB) when coupled both with manipulation of the suspension density within the furnace volume of the circulating fluidized bed steam generator (CFB) of the solids, which are entrained in the hot combustion gases that are generated during the combustion process, which takes place within the circulating fluidized bed steam generator (CFB) and with the distribution of the hot combustion gases through a multichambered backpass volume with which the circulating fluidized bed steam generator (CFB) is suitably provided for this purpose. More specifically, the foregoing desirably would be accomplished through the use of a combination of heat transfer surfaces, which form part of the fluid circuitry of the thermodynamic steam cycle of the circulating fluidized bed steam generator (CFB) and which are located within the furnace volume of the circulating fluidized bed steam generator (CFB). Furthermore, control over the steam, which is supplied to the high pressure turbine and the low pressure turbine would be accomplished by adjusting, either separately or in combination, the aforereferenced suspension density within the furnace volume of the circulating fluidized bed steam generator (CFB), or the distribution of the hot combustion gases amongst the multiple chambers of the backpass volume of the circulating fluidized bed steam generator (CFB). Finally, there has been shown to exist a need for such a new and improved method for controlling the final superheat outlet steam temperature as well as the final reheat outlet steam temperature of a circulating fluidized bed steam generator (CFB) wherein the need for expensive fluidized bed heat exchangers would be eliminated in that the thermodynamic steam cycle duty performed thereby would be performed by heat transfer surfaces located within the furnace volume as well as the multichambered backpass volume of the circulating fluidized bed steam generator (CFB). Such elimination of fluidized bed heat exchangers enables a reduction to be had in the amount of parasitic power, which is consumed by the circulating fluidized bed steam generator (CFB), by virtue of the fact that the fluidizing blowers cooperatively associated with the fluidized bed heat exchangers are eliminated. As a consequence of such elimination of the fluidized bed heat exchangers and the fluidizing blowers cooperatively associated therewith an improvement in plant performance as measured by the amount of BTU's consumed by the circulating fluidized bed steam generator (CFB) per kilowatt of power produced by the circulating fluidized bed steam generator (CFB) would thus be realizable therefrom.

It is, therefore, an object of the present invention to provide a new and improved method for controlling the final superheat outlet steam temperature and the final reheat outlet steam temperature of a circulating fluidized bed steam generator (CFB).

It is another object of the present invention to provide such a new and improved method for controlling the final superheat outlet steam temperature and the final reheat outlet steam temperature of a circulating fluidized bed steam generator (CFB) wherein the circulating fluidized bed steam generator (CFB) embodies a furnace volume having therewithin heat transfer surface.

It is still another object of the present invention to provide such a new and improved method for controlling the final superheat outlet steam temperature and the final reheat outlet steam temperature of a circulating fluidized bed steam generator (CFB) wherein the circulating fluidized bed steam generator (CFB) embodies a backpass volume having therewithin heat transfer surface.

Another object of the present invention is to provide such a new and improved method for controlling the final superheat outlet steam temperature and the final reheat outlet steam temperature of a circulating fluidized bed steam generator (CFB) wherein the circulating fluidized bed steam generator (CFB) embodies both a furnace volume having therewithin heat transfer surface and a backpass volume having therewithin heat transfer surface.

A still another object of the present invention is to provide such a new and improved method for controlling the final superheat outlet steam temperature and the final reheat outlet steam temperature of a circulating fluidized bed steam generator (CFB) wherein the need to employ one or more fluidized bed heat exchangers in order to perform heat transfer duty therewith is obviated.

A further object of the present invention is to provide such a new and improved method for controlling the final superheat outlet steam temperature and the final reheat outlet steam temperature of a circulating fluidized bed steam temperature (CFB) wherein such control is effected as a consequence of the manipulation of the suspension density of the solids within the furnace volume of the circulating fluidized bed steam generator (CFB).

Yet another object of the present invention is to provide such a new and improved method for controlling the final superheat outlet steam temperature and the final reheat outlet steam temperature of a circulating fluidized bed steam generator (CFB) wherein such control is effected as a consequence of the manipulation of the flue gas stream within the backpass volume of the circulating fluidized bed steam generator (CFB).

Yet still another object of the present invention is to provide such a new and improved method for controlling the final superheat outlet steam temperature and the final reheat outlet steam temperature of a circulating fluidized bed steam generator (CFB) wherein such control is effected both as a consequence of the manipulation of the suspension density of the solids within the furnace volume of the circulating fluidized bed steam generator (CFB) and as a consequence of the manipulation of the flue gas stream within the backpass volume of the circulating fluidized bed steam temperature (CFB).

SUMMARY OF THE PRESENT INVENTION

In accordance with the present invention there is provided a method for controlling the final superheat outlet steam temperature and the final reheat outlet steam temperature of a circulating fluidized bed steam generator (CFB), the latter embodying a furnace volume, a cyclone and a multichambered backpass volume and being operative to generate therewithin, in accordance with a preselected thermodynamic steam cycle, steam, which is intended to be supplied to a high pressure turbine and/or a low pressure turbine. The mode of operation of the aforereferenced circulating fluidized bed steam generator (CFB) is such that the generation of steam therefrom commences in the lower segment of the furnace volume of the circulating fluidized bed steam generator CFB) where fuel, sorbent and air are mixed and are subjected to combustion. Hot combustion gases and hot solids are produced as a consequence of such combustion with the hot solids becoming entrained with the hot combustion gases. The term "suspension density" as employed herein refers to the extent to which the hot solids become entrained in the hot combustion gases.

Continuing, the hot combustion gases with the hot solids entrained therewith rise within the furnace volume of the circulating fluidized bed steam generator (CFB), and in the course of doing so heat is transferred therefrom to water that is present within the waterwall tubes, which serve to define the aforesaid furnace volume, whereby steam is evaporatively produced as a result of such transfer of heat to the water. Upon reaching the top of the furnace volume of the circulating fluidized bed steam generator (CFB), the hot combustion gases, now generally referred to as flue gases, with the hot solids still entrained therewith are made to flow through ductwork, which terminates at a cyclone. This cyclone, in known fashion, is operative to effect therewithin the separation from the flue gases of those hot solids, which are above a predetermined size. From the cyclone, the hot solids, which have been separated from the flue gases within the cyclone, are returned to the lower segment of the furnace volume of the circulating fluidized bed steam generator (CFB) for reinjection thereinto.

On the other hand, the flue gases are made to flow from the cyclone through other ductwork to a multichambered backpass volume, with which the circulating fluidized bed steam generator (CFB) is suitably provided, embodying heat transfer surface for the purpose of effecting therewith a portion of the heat transfer duty, which is required to be performed thereby in accordance with the preselected thermodynamic steam cycle of the circulating fluidized bed steam generator (CFB). More specifically, some of this portion of the aforesaid heat transfer duty is accomplished as a result of the transfer of heat during the passage of some of the flue gases through a first chamber of the multichambered backpass volume wherein superheater surface as well as economizer surface are suitably located and as a result of the transfer of heat during the passage of the remaining portion of the flue gases through a second chamber of the multichambered backpass volume wherein reheat surface as well as additional economizer surface are suitably located. Preferably, the apportionment of the flue gases between the aforereferenced first chamber and the aforereferenced second chamber is accomplished by the suitable positioning of dampers, which are provided for this purpose at the exit of the multichambered backpass volume of the circulating fluidized bed steam generator (CFB). After final superheating of the steam has been accomplished in the aforereferenced first chamber of the multichambered backpass volume, the superheat steam is supplied to a high pressure turbine. Likewise, after final reheating of the steam has been accomplished in the aforereferenced second chamber of the multichambered backpass volume, the reheat steam is supplied to a low pressure turbine. In known fashion, these turbines are designed to be cooperatively associated with a generator whereby the generator is driven by these turbines and as a consequence of being so driven by these turbines the generator is operative to produce electricity therefrom.

In addition to that portion of the heat transfer duty, which is required to be performed in accordance with the preselected thermodynamic steam cycle of the circulating fluidized bed steam generator (CFB), that takes place within the aforereferenced first chamber and the aforereferenced second chamber of the multichambered backpass volume of the circulating fluidized bed steam generator (CFB), the remainder of the heat transfer duty that is required to be performed is performed in the furnace volume of the circulating fluidized bed steam generator (CFB). To this end, the furnace volume of the circulating fluidized bed steam generator (CFB) may or may not embody additional superheat surface and/or additional reheat surface, depending upon the specific nature of the thermodynamic steam cycle, which is being employed with a given circulating fluidized bed steam generator (CFB).

In closing, with further regard to the final superheat steam and the final reheat steam, control of the outlet temperature of each is effected in accordance with the method for controlling the final superheat outlet steam temperature and the final reheat outlet steam temperature of a circulating fluidized bed steam generator (CFB) of the present invention as a consequence of the manipulation, either separately or in combination, of the suspension density within the furnace volume of the circulating fluidized bed steam generator (CFB) of the hot solids entrained with the hot combustion gases and of the distribution of the flue gases between the aforereferenced first chamber and the aforereferenced second chamber of the multichambered backpass volume of the circulating fluidized bed steam generator (CFB).

DESCRIPTION OF THE PREFERRED EMBODIMENT

Figure 1:
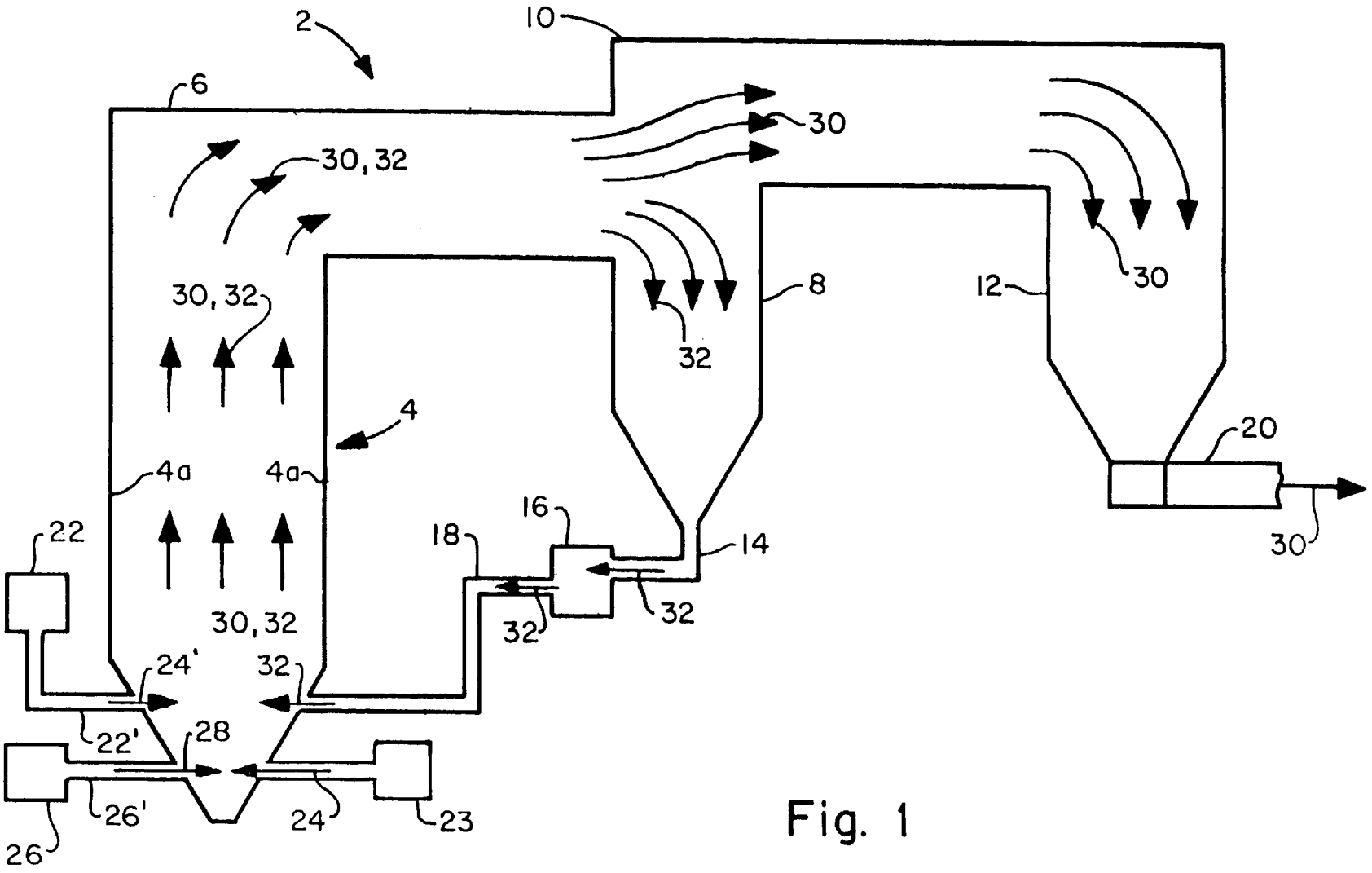
FIG. 1 is a schematic representation in the nature of a side elevational view of a circulating fluidized bed steam generator (CFB) including a furnace volume, a cyclone section, a backpass volume and a seal pot, constructed in accordance with the present invention.

Referring now to FIG. 1 of the drawing, there is depicted therein a circulating fluidized bed steam generator, generally designated by the reference numeral 2. As illustrated in FIG. 1, the circulating fluidized bed steam generator 2 includes a furnace volume, denoted therein by the reference numeral 4, the latter being defined by waterwall tubes, denoted therein by the reference numeral 4*a;* a first section of ductwork, denoted therein by the reference numeral 6; a cyclone section, denoted therein by the reference numeral 8; a second section of ductwork, denoted therein by the reference numeral 10; a backpass volume, denoted therein by the reference numeral 12, from which additional ductwork, denoted therein by the reference numeral 20, extends.

With further reference to FIG. 1 of the drawing, it will be readily apparent therefrom that the lower segment of the cyclone section 8 is connected in fluid flow relation with the lower segment of the furnace volume 4 by means of pipework, which in accordance with the illustration thereof in FIG. 1 consists of a standpipe, denoted therein by the reference numeral 14, a seal pot, denoted therein by the reference numeral 16, and hot solids inlet, denoted therein by the reference numeral 18. For purposes of the discussion that follows, the flow path, which extends from the furnace volume 4 through the first section of ductwork 6 and through the cyclone section 8 and the pipework 14, 16, 18, and returning to the furnace volume 4, will be referred to hereinafter as the hot solids circulation path 4, 6, 8, 14, 16, 18, 4.

Continuing, in accordance with the conventional practice and as will be readily apparent from a reference to FIG. 1 of the drawing, the furnace volume 4 is supplied with a mixture of fuel, denoted therein by the reference numeral 22, and sorbent, denoted therein by the reference numeral 24. This mixture of fuel 22 and sorbent 24 is mixed within the furnace volume 4, for purposes of the combustion therewithin, with primary air, denoted in FIG. 1 by the reference numeral 26, and secondary air, denoted in FIG. 1 by the reference numeral 28. In known fashion, from this combustion hot combustion gases, denoted in FIG. 1 by the reference numeral 30, and hot solids, denoted in FIG. 1 by the reference numeral 32, are produced, with the hot solids 32 becoming entrained in the hot combustion gases 30. These hot combustion gases 30 with the hot solids 32 entrained therewith rise within the furnace volume 4 whereupon at the top of the furnace volume 4 the hot combustion gases 30 with the hot solids 32 entrained therewith are made to flow through the first section of ductwork 6 to the cyclone section 8. Within the cyclone section 8 the hot solids 32 that are made to flow thereto, which are above a predetermined size, are mechanically separated from the hot combustion gases 30 in which they are entrained. The separated hot solids 32, which contain unburned fuel, flyash and sorbent, flow through the cyclone section 8. From the cyclone section 8 the hot solids 32 are discharged under the influence of gravity into the standpipe 14 from whence the hot solids 32 flow through the standpipe 14 to and through the seal pot 16. Thereafter, from the seal pot 16 the hot solids 32 are reintroduced by means of the hot solids inlet 18 into the lower segment of the furnace volume 4 whereupon the hot solids 32 are once again subjected to the combustion process that takes place in the circulating fluidized bed steam generator (CFB) 2.

On the other hand, the hot combustion gases 30 leaving the cyclone section 8, hereinafter referred to as flue gases, are directed from the cyclone section 8 to the backpass volume 12 via the second section of ductwork 10, where additional heat transfer duty is performed therewith as will be described more fully hereinafter. From the backpass volume 12 the flue gases 30 exit through the ductwork 20 and may be utilized to preheat the air, which is supplied to the furnace volume 4 for purposes of effecting therewith the combustion of the fuel 22, whereupon the flue gases 30 are made to flow to a particulate removal system (not shown in the interest of maintaining clarity of illustration in the drawings) and thereafter are discharged through a stack (not shown in the interest of maintaining clarity of illustration in the drawings).

Figure 2:
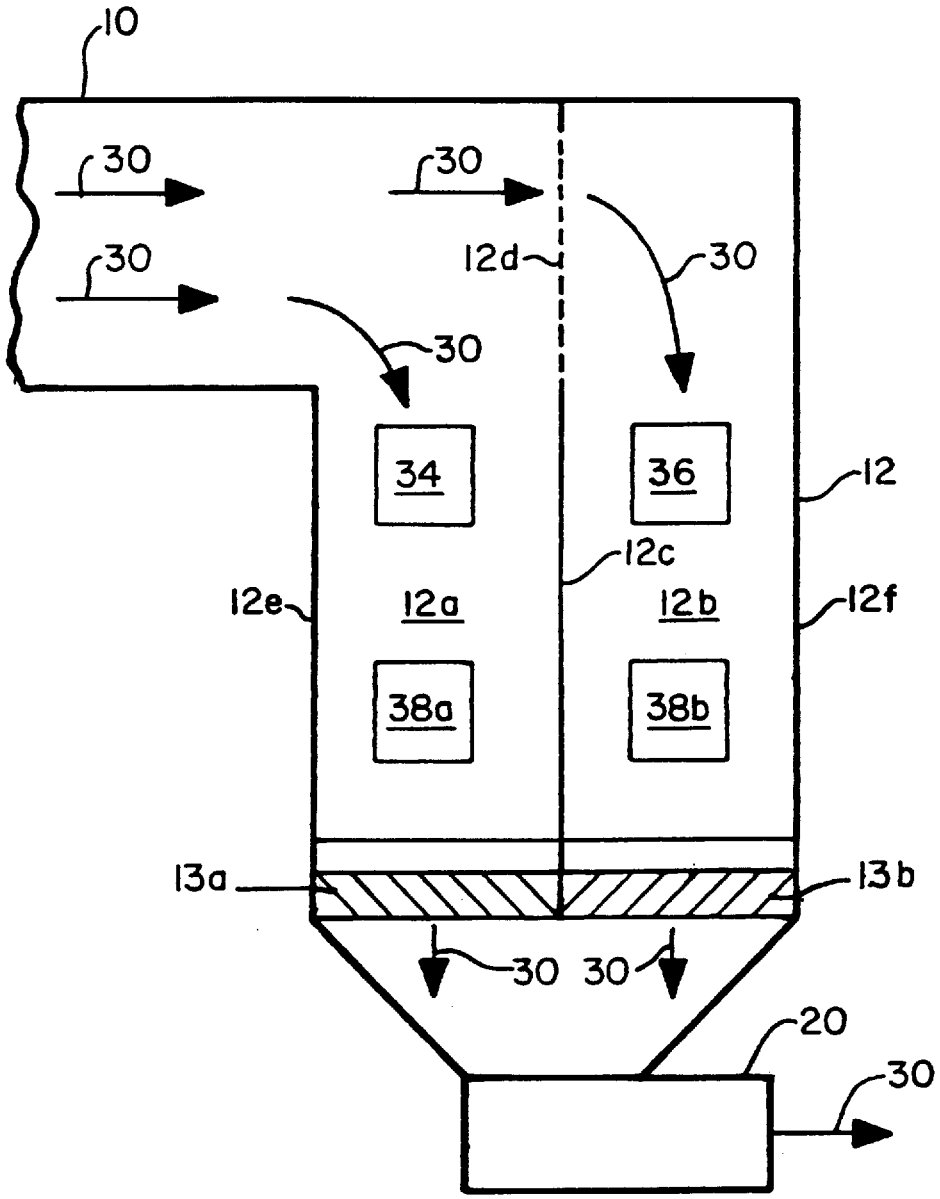
FIG. 2 is a schematic representation in the nature of a side elevational view of the backpass volume, depicted in greater detail, of the circulating fluidized bed steam generator (CFB) illustrated in FIG. 1, constructed in accordance with the present invention.

Reference will next be had herein briefly to FIG. 2 of the drawing wherein there is illustrated a schematic representation in the nature of a side elevational view of the backpass volume 12, depicted therein in greater detail, of the circulating fluidized bed steam generator (CFB) 2. As will be readily apparent from a reference to FIG. 2, the backpass volume 12 is divided by means of a vertical partition, denoted therein by the reference numeral 12*c,* into a first chamber, denoted therein by the reference numeral 12*a,* and into a second chamber, denoted therein by the reference numeral 12*b.* Also as will be readily understood from a reference to FIG. 2 of the drawing, the upper portion of the backpass volume 12 is suitably provided with an opening, denoted therein by the reference numeral 12*d,* which is designed to be operative for the purpose of enabling the flue gases 30, which are flowing through the second section of ductwork 10, upon exiting therefrom, to flow, as will be more fully discussed hereinafter, either into the first chamber 12*a* or into the second chamber 12*b.*

With further reference to FIG. 2 of the drawing, as will be readily understood therefrom the vertical partition 12*c* comprises a wall of finned tubes, which are suitably interconnected one with another such as to effect therewith the isolation below the opening 12*d* of the first chamber 12*a* and of the second chamber 12*b* one from another. Furthermore, as will be readily apparent from a reference to FIG. 2 of the drawing the backpass volume 12 is itself defined by a front wall, denoted therein by the reference numeral 12*e,* a back wall, denoted therein by the reference numeral 12*f,* a roof, denoted therein by the reference numeral 12*h,* and a pair of side walls (not shown in the interest of maintaining clarity of illustration in the drawing). The front wall 12*e,* the back wall 12*f,* the roof 12*h* and the pair of side walls (not shown in the interest of maintaining clarity of illustration in the drawing) preferably are each constructed in a manner like that of the vertical partition 12*c,* i.e., each comprises a surface formed of finned tubes interconnected one with another so as to thereby form a solid surface therefrom. In addition to the foregoing, the backpass volume 12 also includes a first set of dampers, denoted in FIG. 2 by the reference numeral 13*a,* which is suitably mounted for movement between an open and a closed position at the exit end of the first chamber 12*a* of the backpass volume 12, and a second set of dampers, denoted in FIG. 2 by the reference numeral 13*b,* which is suitably mounted for movement between an open and a closed position at the exit end of the second chamber 12*b* of the backpass volume 12. The first set of dampers 13*a* and the second set of dampers 13*b* are designed to be operative to effect therewith control over the extent to which the flue gases 30 flow into the first chamber 12*a* and into the second chamber 12*b*. For purposes of completing the description hereat of the backpass volume 12, reference is made here to the fact that there is suitably housed within the first chamber 12*a* a superheater surface, denoted in FIG. 2 by the reference numeral 34, followed by a first economizer surface, denoted in FIG. 2 by the reference numeral 38*a,* and that there is suitably housed within the second chamber 12*b* a reheater surface, denoted in FIG. 2 by the reference numeral 36, followed by a second economizer surface, denoted in FIG. 2 by the reference numeral 38*b*. To this end, as will be discussed more fully hereinafter the superheater surface 34, the reheater surface 36, the first economizer surface 38*a* and the second economizer surface 38*b* all comprise a part of the thermodynamic steam cycle of the circulating fluidized bed steam generator (CFB) 2.

Figure 3:
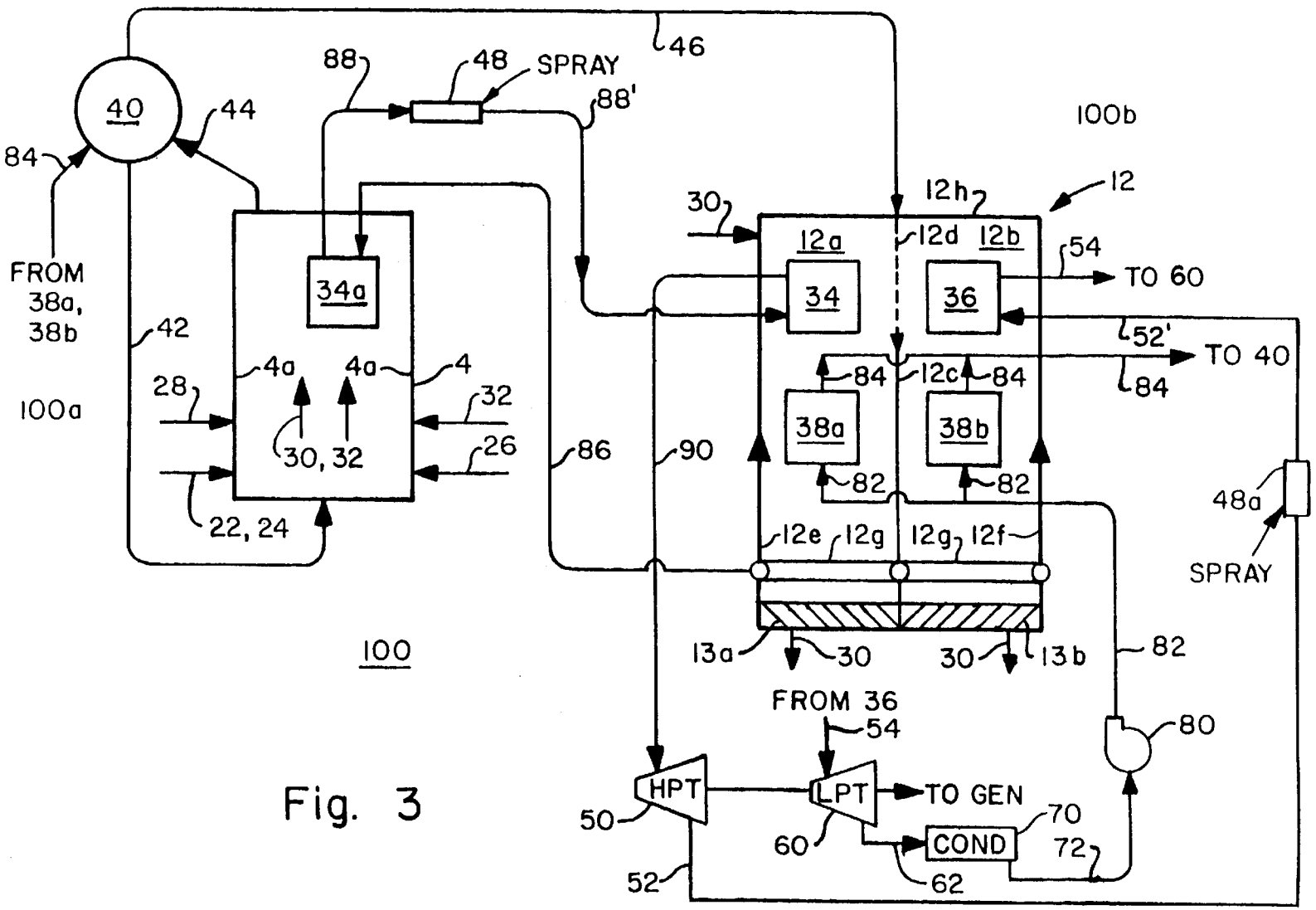
FIG. 3 is a simplified schematic representation of one embodiment of the fluid circuitry of the thermodynamic steam cycle employable with a circulating fluidized bed steam generator (CFB) such as the circulating fluidized bed steam generator (CFB) illustrated in FIG. 1, constructed in accordance with the present invention.

For purposes of better understanding how the combustion process, which takes place within the furnace volume 4 of the circulating fluidized bed steam generator (CFB) 2, is integrated with the hot solids circulation path 4, 6, 8, 14, 16, 18, 4 and with the flow path of the flue gases 30 and with the various thermodynamic steam cycle, denoted by the reference numerals 100, 200, 300, 400, which are illustrated in FIGS. 3, 4, 5 and 6, respectively, of the drawings, that are employable with a circulating fluidized bed steam generator (CFB) such as the circulating fluidized bed steam generator (CFB) 2, reference will now be had in succession to each of FIGS. 3, 4, 5 and 6 commencing with FIG. 3 of the drawing. To this end, in FIG. 3 of the drawing there is illustrated a simplified schematic representation of one embodiment of the fluid circuitry of the thermodynamic steam cycle, denoted therein by the reference numeral 100, which is employable in accordance with the present invention with the circulating fluidized bed steam generator (CFB) 2. For purposes of the description that follows hereinafter of the thermodynamic steam cycle 100 of the circulating fluidized bed steam generator (CFB) 2, note is made here of the fact that the fluid circuitry of the thermodynamic steam cycle 100 encompasses a multiplicity of downcomers, risers, tubes, headers, piping links, etc. through which water and steam as necessary are made to flow in accordance with the requirements as determined by the nature of the thermodynamic steam cycle 100. Furthermore, the thermodynamic steam cycle 100, as will be best understood with reference to FIG. 3 of the drawing, is comprised of a first circulatory fluid flow path, denoted therein by the reference numeral 100*a,* and a second circulatory fluid flow path, denoted therein by the reference numeral 100*b*. With further reference thereto, the first circulatory fluid flow path 100*a* is designed to be operative as an evaporative steam loop, denoted in FIG. 3 by the reference numerals 40, 42, 4*a,* 44, 40. The second circulatory fluid flow path 100*b,* on the other hand, which is designed to be operative as a superheat steam-reheat steam loop, includes a saturated steam segment, denoted in FIG. 3 by the reference numerals 46, 12*c,* 12*g,* 12*e,* 12*f,* 12*h,* 86, a superheat steam segment, denoted in FIG. 3 by the reference numerals 34*a,* 88, 48, 88', 34, 90, 50, 52, 48*a,* 52', a reheat steam segment, denoted in FIG. 3 by the reference numerals 36, 54, 60, 62, and an economizer segment, denoted in FIG. 3 by the reference numerals 70, 72, 80, 82, 38*a,* 38*b,* 84, 40.

The evaporative steam loop 40, 42, 4*a,* 44, 40 becomes operative as a function of the combustion process, which takes place within the furnace volume 4. As has been noted herein previously, as the hot combustion gases 30 with the hot solids 32 entrained therewith rise within the furnace volume 4 heat is transferred therefrom to the waterwall tubes 4*a,* which serve to define the furnace volume 4. As a consequence thereof, the saturated water, which enters the waterwall tubes 4*a* from the steam drum, denoted in FIG. 3 by the reference numeral 40, via a downcomer, denoted in FIG. 3 by the reference numeral 42, is evaporatively changed to a mixture of saturated water and saturated steam as the saturated water, which has entered the waterwall tubes 4*a* from the steam drum 40, rises within the waterwall tubes 4*a*. Thereafter, this mixture of saturated water and saturated steam is made to flow to the steam drum 40 for separation wherein after separation the saturated water is once again made to flow to the lower segment of the waterwall tubes 4*a* via the downcomer 42 while after separation the saturated steam is made to flow to the vertical partition 12*c* via a piping link, denoted in FIG. 3 by the reference numeral 46, and a common header (not shown in the interest of maintaining clarity of illustration in the drawing).

Continuing, the saturated steam, which is made to flow to the vertical partition 12*c,* is then caused to circulate through the backpass volume 12. More specifically, the saturated steam circulates through the vertical partition 12*c,* a lower ring header, denoted in FIG. 3 by the reference numeral 12*g,* the front wall 12*e,* the back wall 12*f,* and the roof 12*h*. In the course of such circulation through the backpass volume 12, the saturated steam is operative to effect therewith a cooling thereof, i.e., a cooling of the vertical partition 12*c,* the front wall 12*e,* the back wall 12*f,* and the roof 12*h*. Although the aforesaid cooling has been described above as being accomplished through the use of steam, it is to be understood that such cooling could also be accomplished, without departing from the essence of the present invention, through the use of water. After the saturated steam has circulated through the backpass volume 12 in the aforedescribed manner, the saturated steam is then made to flow via a piping link, denoted in FIG. 3 of the drawing by the reference numeral 86, to a low temperature superheater, denoted in FIG. 3 by the reference numeral 34*a,* suitably located for this purpose in the upper segment of the furnace volume 4.

As the saturated steam flows through the low temperature superheater 34*a,* a transfer of heat takes place between the relatively cool saturated steam and the relatively hot combustion gases 30 with the hot solids 32 entrained therewith as the hot combustion gases 30 with the hot solids 32 entrained therewith rise within the furnace volume 4, to which reference has been had herein previously. The saturated steam, which exits by means of a piping link, denoted in FIG. 3 by the reference numeral 88, from the low temperature superheater 34*a,* is now in a superheat state. In accordance with the best mode embodiment of the invention, control over the temperature of the superheat steam exiting from the low temperature superheater 34*a* is effected through the use of a superheat spray desuperheater, denoted in FIG. 3 by the reference numeral 48.

As will be readily understood from a reference to FIG. 3 of the drawing, from the superheat spray desuperheater 48 the still superheated steam flows via a piping link, denoted in FIG. 3 by the reference numeral 88', to the finishing superheater 34 located within the first chamber 12*a* of the backpass volume 12. In the finishing superheater 34 a transfer of heat takes place between the relatively cool superheated steam and the relatively hot flue gases 30 that flow through the first chamber 12*a,* to which reference has been had herein previously, whereby the superheat steam is further superheated. Upon exiting from the finishing superheater 34 the final superheat steam now being at a predefined final superheat outlet steam temperature is in a highly superheated state and is made to flow by means of a piping link, denoted in FIG. 3 by the reference numeral 90, to the high pressure turbine 50. Within the high pressure turbine 50 the final superheat steam in known fashion undergoes expansion. Thereafter, the superheat steam is made to flow by means of a piping link, denoted in FIG. 3 by the reference numeral 52, from the high pressure turbine 50 to a reheat spray desuperheater, denoted in FIG. 3 by the reference numeral 48*a,* and then by means of a piping link, denoted in FIG. 3 by the reference numeral 52', to the reheater 36, which is located within the second chamber 12*b* of the backpass volume 12.

Continuing with the description of the circulatory flow path, which the thermodynamic steam cycle 100 embodies, in the reheater 36 a transfer of heat takes place between the relatively cool yet still superheated steam and the relatively hot flue gases 30 that flow through the second chamber 12*b,* to which reference has been had herein previously, whereby the superheat steam is further superheated. Upon exiting from the reheater 36 the final reheat steam now being at a predefined final reheat outlet steam temperature is still in a highly superheated state and is made to flow by means of a piping link, denoted in FIG. 3 by the reference numeral 54, to the low pressure turbine 60. Within the low pressure turbine 60 the final reheat steam in known fashion undergoes further expansion. Thereafter, the now saturated steam is made to flow by means of a piping link, denoted in FIG. 3 by the reference numeral 62, to a condenser, denoted in FIG. 3 by the reference numeral 70, wherein the saturated steam is condensed to feedwater. The feedwater is then made to flow by means of the piping link, denoted in FIG. 3 by the reference numerals 72, 82, and by means of the feedpump, denoted in FIG. 3 by the reference numeral 80, from the condenser 70 to the first economizer surface 38*a,* which is located in the first chamber 12*a* of the backpass volume 12, and to the second economizer surface 38*b,* which is located within the second chamber 12*b* of the backpass volume 12. From the first economizer surface 38*a* and the second economizer surface 38*b* the feedwater, which is now in a saturated state, is made to flow by means of a piping link, denoted in FIG. 3 by the reference numeral 84, to the steam drum 40 thereby completing the circulatory fluid flow path in accordance with the present invention of the thermodynamic steam cycle 100.

It is to be noted herein that the steam produced, be it by any given one of the thermodynamic steam cycles, denoted in FIGS. 3, 4, 5 and 6 by the reference numerals 100, 200, 300 and 400, respectively, which in accordance with the present invention are employable with the circulating fluidized bed steam generator (CFB) 2, is operative in known fashion to provide the motive power, which is required to drive the high pressure turbine 50 as well as the low pressure turbine 60. The high pressure turbine 50 and the low pressure turbine 60 in turn are cooperatively associated with a generator (not shown in the interest of maintaining clarity of illustration in the drawing), which is operative to produce electricity in a conventional manner.

Figure 7:
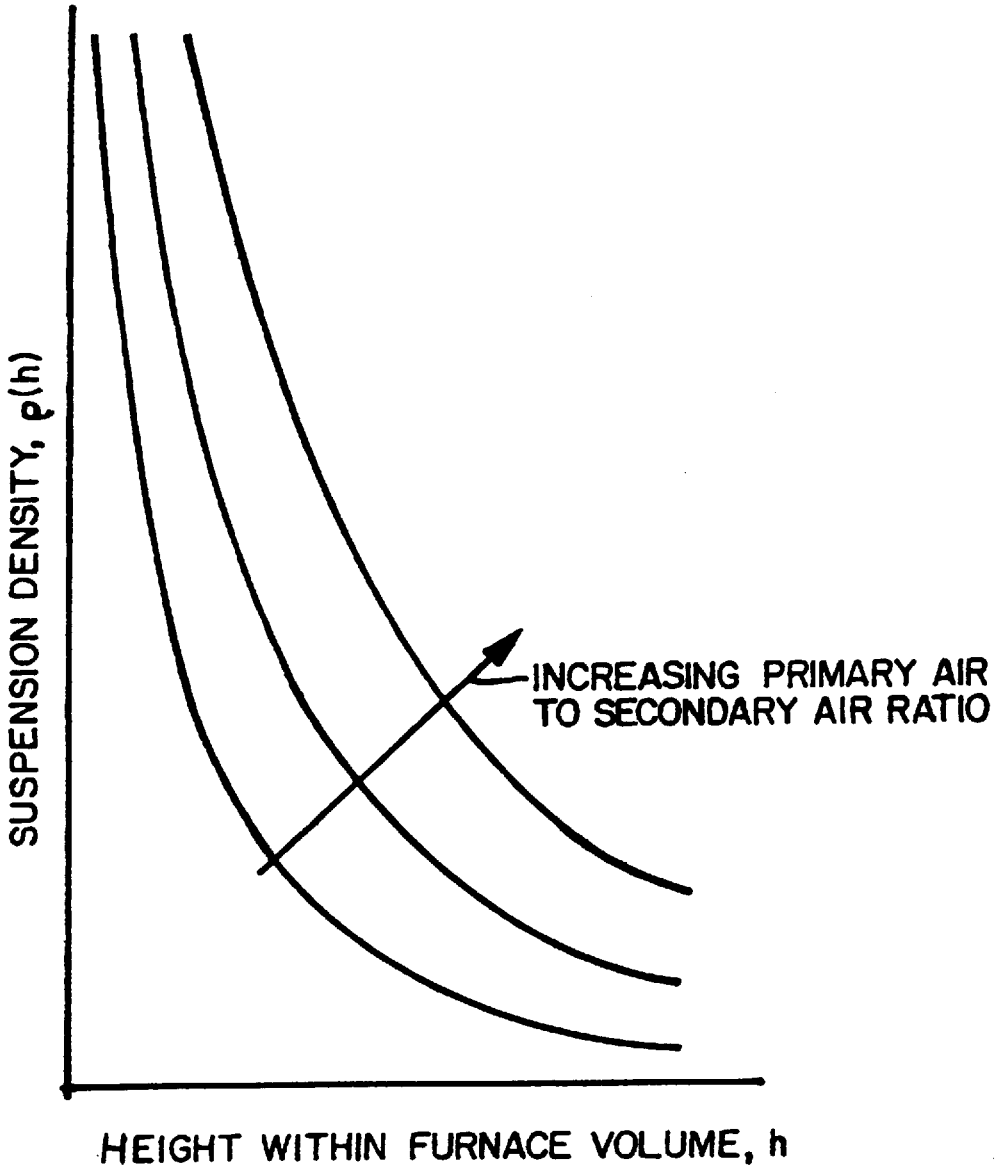
FIG. 7 is a graphical presentation both of the suspension density of the hot solids within the furnace volume of the circulating fluidized bed steam generator (CFB) as a function of the height of the aforereferenced furnace volume and of the change in the profile of such suspension density as a result of a change in the ratio between the primary air and the secondary air that are introduced into the aforereferenced furnace volume.

In addition to the control exercised over the superheat steam and the reheat steam, which has been described hereinbefore, it is possible in accordance with the present invention to effect further control over the outlet temperature of the final superheat steam and over the outlet temperature of the final reheat steam. To this end, such further control over the outlet temperature of the final superheat steam and over the outlet temperature of the final reheat is effected in accordance with the present invention through manipulation, either separately or in combination, of the suspension density of the hot solids 32 within the furnace volume 4 and of the extent to which the flue gases 30 are distributed between the first chamber 12*a* and the second chamber 12*b* of the backpass volume 12. More specifically, as will be best understood with reference to FIG. 7 of the drawing, if the profile of the suspension density of the hot solids 32 within the furnace volume 4 is shifted as a result of the ratio of primary air 26 to secondary air 28 being increased, this will result in more hot solids 32 rising within the furnace volume 4 to the upper segment thereof. As such, within the upper segment of the furnace volume 4 there will be more energy available to be transferred from the hot combustion gases 30 with which the hot solids 32 are entrained to the saturated steam, which flows into the low temperature superheater 34*a*. In turn this will cause the temperature of the superheat steam, which exits from the low temperature superheater 34*a,* to rise and concomitantly results in an increase in the temperature of the superheat steam, which flows to the finishing superheater 34. Consequently, with no other changes occurring in the backpass volume 12, there will, therefore, be realized an increase in the outlet temperature of the final superheat steam. Conversely, if the ratio of primary air 26 to secondary air 28 is decreased, this will result in fewer hot solids 32 rising within the furnace volume 4 to the upper segment thereof. In turn, this will ultimately result in a decrease in the outlet temperature of the final superheat steam.

Consideration will next be had herein to the matter of the distribution of the flue gases 30 between the first chamber 12*a* and the second chamber 12*b* of the backpass volume 12. Such distribution in accordance with the preferred embodiment of the invention is effected through manipulation of the first set of dampers 13*a,* which as has been described herein previously is suitably mounted for movement between an open and a closed position at the exit end of the first chamber 12*a,* as well as through manipulation of the second set of dampers 13*b,* which as has been described herein previously is suitably mounted for movement between an open and a closed position at the exit end of the second chamber 12*b*. To this end, through manipulation of the first set of dampers 13*a* and of the second set of dampers 13*b*, the flue gases 30 may be made to flow to a greater or lesser extent through either the first chamber 12*a* or the second chamber 12*b*. Consequently, depending upon the extent to which the flue gases 30 are apportioned between the first chamber 12*a* and the second chamber 12*b*, more or less energy, i.e., more or less heat, will be available to be transferred from the flue gases 30 to the finishing superheater 34 and the first economizer surface 38*a*, which are located within the first chamber 12*a* of the backpass volume 12, or to the reheater 36 and the second economizer surface 38*b*, which are located within the second chamber 12*b* of the backpass volume 12. Namely, if the flue gases 30 are directed to a greater extent to the first chamber 12*a* than they are to the second chamber 12*b*, this will result in an increase in the outlet temperature of the final superheat steam and concomitantly a decrease in the outlet temperature of the final reheat steam. Conversely, if the flue gases 30 are directed to a greater extent to the second chamber 12*b* than they are to the first chamber 12*a*, this will result in an increase in the outlet temperature of the final reheat steam and concomitantly a decrease in the outlet temperature of the final superheat steam.

Figure 4:
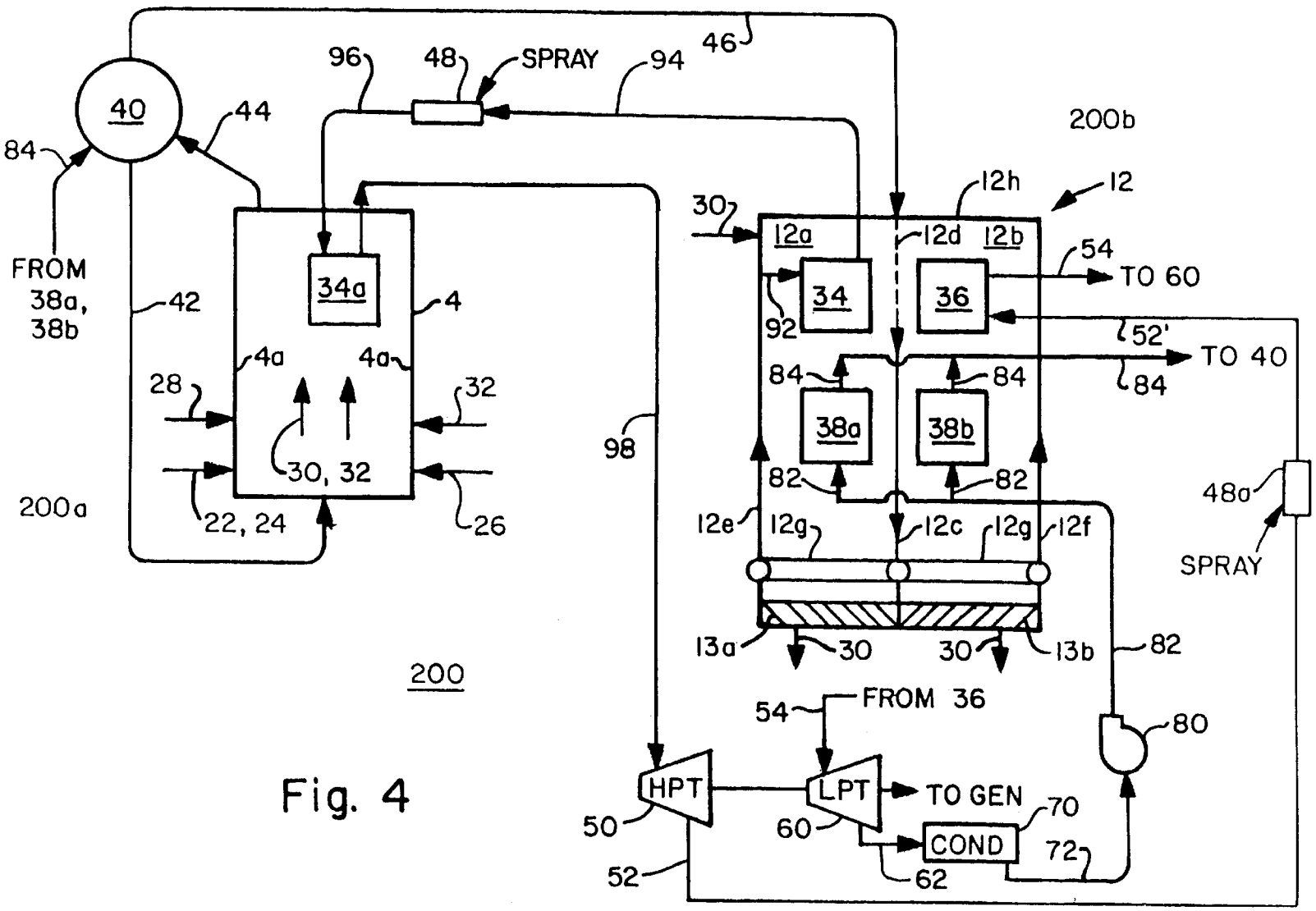
FIG. 4 is a simplified schematic representation of a second embodiment of the fluid circuitry of the thermodynamic steam cycle employable with a circulating fluidized bed steam generator (CFB) such as the circulating fluidized bed steam generator (CFB) illustrated in FIG. 1, constructed in accordance with the present invention.

A description will next be had herein of the thermodynamic steam cycle 200, which is illustrated in FIG. 4 of the drawing. For purposes of the description that follows hereinafter of the thermodynamic steam cycle 200 of the circulating fluidized bed steam generator (CFB) 2, note is made here of the fact that the fluid flow circuitry of the thermodynamic steam cycle 200 encompasses a multiplicity of downcomers, risers, tubes, headers, piping links, etc. through which water and steam as necessary are made to flow in accordance with the requirements as determined by the nature of the thermodynamic steam cycle 200. As will be best understood with reference to FIG. 4 of the drawing, the thermodynamic steam cycle 200 is comprised of a first circulatory fluid flow path, denoted therein by the reference numeral 200*a*, and a second circulatory fluid flow path, denoted therein by the reference numeral 200*b*. With further reference thereto, the first circulatory fluid flow path 200*a* is designed to be operative as an evaporative steam loop, denoted in FIG. 4 by the reference numerals 40, 42, 4*a*, 44, 40. The second circulatory fluid flow path 200*b*, on the other hand, is designed to be operative as a superheat steam-reheat steam loop. To this end, the superheat steam-reheat steam loop includes a saturated steam segment, denoted in FIG. 4 by the reference numerals, 46, 12*c*, 12*g*, 12*e*, 12*f*, 12*h*, 92, a superheat steam segment, denoted in FIG. 4 by the reference numerals 94, 48, 96, 34*a*, 98, 50, 52, 48*a*, 52', a reheat steam segment, denoted in FIG. 4 by the reference numerals 70, 72, 80, 82, 38*a*, 38*b*, 84, 40.

The evaporative steam loop 40, 42, 4*a*, 44, 40 becomes operative as a function of the combustion process, which takes place within the furnace volume 4. As has been noted herein previously, as the hot combustion gases 30 with the hot solids 32 entrained therewith rise within the furnace volume 4 heat is transferred therefrom to the waterwall tubes 4*a*, which serve to define the furnace volume 4. As a consequence thereof, the saturated water, which enters the waterwall tubes 4*a* from the steam drum, denoted in FIG. 4 by the reference numeral 40, via a downcomer, denoted in FIG. 4 by the reference numeral 42, is evaporatively changed to a mixture of saturated water and saturated steam as the saturated water, which has entered the waterwall tubes 4*a* from the steam drum 40, then rises within the waterwall tubes 4*a*. Thereafter, this mixture of saturated water and saturated steam is made to flow to the steam drum 40 for separation wherein after separation the saturated water is once again made to flow to the lower segment of the waterwall tubes 4*a* via the downcomer 42 while after separation the saturated steam is made to flow to the vertical partition 12*c* via a piping link, denoted in FIG. 4 by the reference numeral 46, and a common header (not shown in the interest of maintaining clarity of illustration in the drawing).

Continuing, the saturated steam, which is made to flow to the vertical partition 12*c*, is then caused to circulate through the backpass volume 12. More specifically, the saturated steam circulates through the vertical partition 12*c*, a lower ring header, denoted in FIG. 4 by the reference numeral 12*g*, the front wall 12*e*, the back wall 12*f*, and the roof 12*h*. In the course of such circulation through the backpass volume 12, the saturated steam is operative to effect therewith a cooling thereof, i.e., a cooling of the vertical partition 12*c*, the front wall 12*e*, the back wall 12*f*, and the roof 12*h*. Although the aforesaid cooling has been described above as being accomplished through the use of steam, it is to be understood that such cooling could also be accomplished, without departing from the essence of the present invention, through the use of water. After the saturated steam has circulated through the backpass volume 12 in the aforedescribed manner, the saturated steam is then made to flow via a piping link, denoted in FIG. 4 of the drawing by the reference numeral 92, to a low temperature superheater, denoted in FIG. 4 by the reference numeral 34, suitably located for this purpose in the upper segment of the first chamber 12*a* of the backpass volume 12. As the saturated steam flows through the low temperature superheater 34, a transfer of heat takes place between the relatively cool saturated steam and the hot flue gases 30 that as has been described herein previously flow through the first chamber 12*a*. The saturated steam, which exits from the low temperature superheater 34, is now in a superheated state. In accordance with the best mode embodiment of the invention, control over the temperature of the superheated steam exiting from the low temperature superheater 34 is effected through the use of a superheat spray desuperheater, denoted in FIG. 4 by the reference numeral 48.

As will be readily understood from a reference to FIG. 4 of the drawing, from the superheat spray desuperheater 48 the still superheated steam flows via a piping link, denoted in FIG. 4 by the reference numeral 96, to the finishing superheater, denoted in FIG. 4 by the reference numeral 34*a*, suitably located for this purpose within the upper segment of the furnace volume 4. In the finishing superheater 34*a* a transfer of heat takes place between the relatively cool superheat steam and the relatively hot combustion gases 30 with the hot solids 32 entrained therewith as the hot combustion gases 30 with the hot solids entrained therewith rise within the furnace volume 4, to which reference has been had herein previously, whereby the superheat steam is further superheated. Upon exiting from the finishing superheater 34*a* the final superheat steam now being at a predefined final superheat outlet steam temperature is in a highly superheated state and is made to flow by means of a piping link, denoted in FIG. 4 by the reference numeral 98, to the high pressure turbine 50.

Within the high pressure turbine 50 the final superheat steam undergoes expansion. Thereafter, the superheat steam is made to flow by means of a piping link, denoted in FIG. 4 by the reference numeral 52, from the high pressure turbine 50 to a reheat spray desuperheater, denoted in FIG.

4 by the reference numeral 48*a,* and then by means of a piping link, denoted in FIG. 4 by the reference numeral 52', to the reheater 36, which is located within the second chamber 12*b* of the backpass volume 12. In the reheater 36 a transfer of heat takes place between the relatively cool superheat steam and the relatively hot flue gases 30 that flow through the second chamber 12*b,* to which reference has been had herein previously, whereby the superheat steam is further superheated. Upon exiting from the reheater 36 the final reheat steam now being at a predefined final reheat outlet steam temperature is still in a highly superheated state and is made to flow to the low pressure turbine 60. Within the low pressure turbine 60 the final reheat steam in known fashion undergoes further expansion. Thereafter, the now saturated steam is made to flow by means of a piping link, denoted in FIG. 4 by the reference numeral 62, to a condenser, denoted in FIG. 4 by the reference numeral 70, wherein the saturated water is condensed to feedwater. The feedwater is then made to flow by means of the piping link, denoted in FIG. 4 by the reference numerals 72, 82, and by means of the feedpump, denoted in FIG. 4 by the reference numeral 80, from the condenser 70 to the first economizer surface 38*a,* which is located in the first chamber 12*a* of the backpass volume 12, and to the second economizer surface 38*b,* which is located within the second chamber 12*b* of the backpass volume 12. From the first economizer surface 38*a* and the second economizer surface 38*b* the feedwater, which is now in a saturated state, is made to flow by means of a piping link, denoted in FIG. 4 by the reference numeral 84, to the steam drum 40 thereby completing the circulatory fluid flow path in accordance with the present invention of the thermodynamic steam cycle 200.

In addition to the control exercised over the superheat steam and the reheat steam, which has been described hereinbefore, it is possible in accordance with the present invention to effect further control over the outlet temperature of the final superheat steam and over the outlet temperature of the final reheat steam. To this end, such further control over the outlet temperature of the final superheat steam and over the outlet temperature of the final reheat steam is effected, in accordance with the present invention, through manipulation, either separately or in combination, of the suspension density of the hot solids 32 within the furnace volume 4 and of the extent to which the flue gases 30 are distributed between the first chamber 12*a* and the second chamber 12*b* of the backpass volume 12. More specifically, as will be best understood with reference to FIG. 7 of the drawing, if the profile of the suspension density of the hot solids 32 within the furnace volume 4 is shifted as a result of the ratio of primary air 26 to secondary air 28 being increased, this will result in more hot solids 32 rising within the furnace volume 4 to the upper segment thereof. As such, within the upper segment of the furnace volume 4 there will be more energy available to be transferred from the hot combustion gases 30 with which the hot solids 32 are entrained to the saturated steam, which flows into the finishing superheater 34*a.* In turn this will cause the outlet temperature of the final superheat steam, which flows from the finishing superheater 34*a* to the high pressure turbine 50, to rise. Conversely, if the ratio of primary air 26 to secondary air 28 is decreased, this will result in fewer hot solids 32 rising within the furnace volume 4 to the upper segment thereof with the concomitant effect that the outlet temperature of the final superheat steam, which flows from the finishing superheater 34*a* to the high pressure turbine 50, is decreased.

Consideration will next be had herein to the matter of the distribution of the flue gases 30 between the first chamber 12*a* and the second chamber 12*b* of the backpass volume 12. Such distribution in accordance with the preferred embodiment of the invention is effected through manipulation of the first set of dampers 13*a,* which as has been described herein previously is suitably mounted for movement between an open and a closed position at the exit end of the first chamber 12*a,* as well as through manipulation of the second set of dampers 13*b,* which as has been described herein previously is suitably mounted for movement between an open and a closed position at the exit end of the second chamber 12*b.* To this end, through manipulation of the first set of dampers 13*a* and of the second set of dampers 13*b,* the flue gases 30 may be made to flow to a greater or to a lesser extent through either the first chamber 12*a* or the second chamber 12*b.* Consequently, depending upon the extent to which the flue gases 30 are apportioned between the first chamber 12*a* and the second chamber 12*b,* more or less energy, i.e., more or less heat, will be available to be transferred from the flue gases 30 to the low temperature superheater 34 and the first economizer surface 38*a,* which are located within the first chamber 12*a* of the backpass volume 12, or to the reheater 36 and the second economizer surface 38*b,* which are located within the second chamber 12*b* of the backpass volume 12. Namely, if the flue gases 30 are directed to a greater extent to the first chamber 12*a* than they are to the second chamber 12*b,* this will result in an increase in the temperature of the superheat steam exiting from the low temperature superheater 34 and concomitantly a decrease in the outlet temperature of the final reheat steam. Conversely, if the flue gases 30 are directed to a greater extent to the second chamber 12*b* than they are to the first chamber 12*a,* this will result in an increase in the outlet temperature of the final reheat steam and concomitantly a decrease in the temperature of the superheat steam entering the finishing superheater 34*a* from the low temperature superheater 34.

Figure 5:
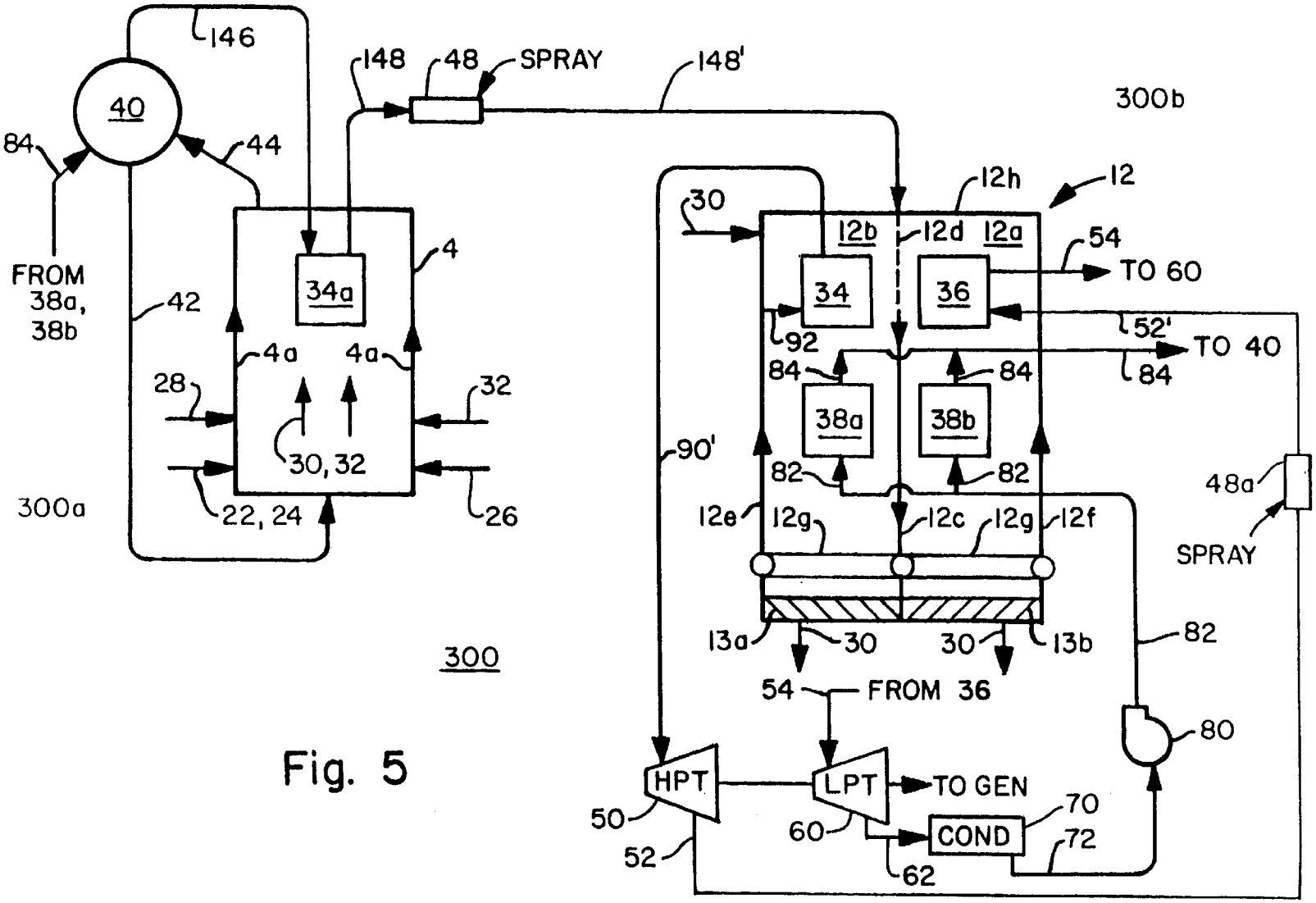
FIG. 5 is a simplified schematic representation of a third embodiment of the fluid circuitry of the thermodynamic steam cycle employable with a circulating fluidized bed steam generator (CFB) such as the circulating fluidized bed steam generator (CFB) illustrated in FIG. 1, constructed in accordance with the present invention.

A description will next be had herein of the thermodynamic steam cycle 300, which is illustrated in FIG. 5 of the drawing. For purposes of the description that follows hereinafter of the thermodynamic steam cycle 300 of the circulating fluidized bed steam generator (CFB) 2, note is made here of the fact that the fluid flow circuitry of the thermodynamic steam cycle 300 encompasses a multiplicity of downcomers, risers, tubes, headers, piping links, etc. through which water and steam as necessary are made to flow in accordance with the requirements as determined by the nature of the thermodynamic steam cycle 300. As will be best understood with reference to FIG. 5 of the drawing, the thermodynamic steam cycle 300 is comprised of a first circulatory fluid flow path, denoted therein by the reference numeral 300*a,* and a second circulatory fluid flow path, denoted therein by the reference numeral 300*b.* With further reference thereto, the first circulatory fluid flow path 300*a* is designed to be operative as an evaporative steam loop, denoted in FIG. 5 by the reference numerals 40, 42, 4*a,* 44, 40. The second circulatory fluid flow path 300*b,* on the other hand, is designed to be operative as a superheat steam-reheat steam loop. To this end, the superheat steam-reheat steam loop includes a saturated steam segment, denoted in FIG. 5 by the reference numeral 146, a first superheat steam segment, denoted in FIG. 5 by the reference numerals 34*a,* 148, 48, 148', 12*c,* 12*g,* 12*e,* 12*f,* 12*h,* 92, a second superheat steam segment, denoted in FIG. 5 by the reference numerals 34, 90', 50, 52, 48*a,* 52', a reheat steam segment, denoted in FIG. 5 by the reference numerals 36, 54, 60, 62, and an economizer segment, denoted in FIG. 5 by the reference numerals 70, 72, 80, 82, 38*a,* 38*b,* 84, 40.

The evaporative steam loop 40, 42, 4*a,* 44, 40 becomes operative as a function of the combustion process, which takes place within the furnace volume 4. As has been noted herein previously, as the hot combustion gases 30 with the hot solids 32 entrained therewith rise within the furnace volume 4 heat is transferred therefrom to the waterwall tubes 4*a,* which serve to define the furnace volume 4*a*. As a consequence thereof, the saturated water, which enters the waterwall tubes 4*a* from the steam drum, denoted in FIG. 5 by the reference numeral 40, via a downcomer, denoted in FIG. 5 by the reference numeral 42, is evaporatively changed to a mixture of saturated water and saturated steam as the saturated steam, which has entered the waterwall tubes 4*a* from the steam drum 40, then rises within the waterwall tubes 4*a*. Thereafter, this mixture of saturated water and saturated steam is made to flow to the steam drum 40 via a riser, denoted in FIG. 5 by the reference numeral 44, for separation. After separation the saturated water is once again made to flow from the steam drum 40 to the lower segment of the waterwall tubes 4*a* via the downcomer 42 whereas after separation the saturated steam is made to flow via a piping link, denoted in FIG. 5 by the reference numeral 146, from the steam drum 40 to the low temperature superheater, denoted in FIG. 5 by the reference numeral 34*a,* which is suitably located for this purpose within the upper segment of the furnace volume 4 of the circulating fluidized bed steam generator (CFB) 2. As the saturated steam flows through the low temperature superheater 34*a,* a transfer of heat takes place between the relatively cool saturated steam and the relatively hot combustion gases 30 with the hot solids 32 entrained therewith as the hot combustion gases 30 with the hot solids 32 entrained therewith rise within the furnace volume 4, to which reference has been had herein previously. The saturated steam, which exits by means of a piping link, denoted in FIG. 5 by the reference numeral 148, from the low temperature superheater 34*a,* is now in a superheat state. In accordance with the best mode embodiment of the invention, control over the temperature of the superheat steam exiting from the low temperature superheater 34*a* is effected through the use of a superheat spray desuperheater, denoted in FIG. 5 by the reference numeral 48.

From the superheat spray desuperheater 48, the still superheat steam is made to flow to the vertical partition 12*c* via a piping link, denoted in FIG. 5 by the reference numeral 148', and a common header (not shown in the interest of maintaining clarity of illustration in the drawing). The superheat steam, which is made to flow to the vertical partition 12*c,* is then caused to circulate through the backpass volume 12. More specifically, the superheat steam circulates through the vertical partition 12*c,* a lower ring header, denoted in FIG. 5 by the reference numeral 12*g,* the front wall 12*e,* the back wall 12*f,* and the roof 12*h*. In the course of such circulation through the backpass volume 12, the superheat steam is operative to effect therewith a cooling thereof, i.e., a cooling of the vertical partition 12*c,* the front wall 12*e,* the back wall 12*f,* and the roof 12*h*. Although the aforesaid cooling has been described above as being accomplished through the use of steam, it is to be understood that such cooling could also be accomplished, without departing from the essence of the present invention, through the use of water. After the saturated steam has circulated through the backpass volume 12 in the aforedescribed manner, the superheat steam is then made to flow to a finishing superheater, denoted in FIG. 5 by the reference numeral 34, suitably located for this purpose in the upper segment of the first chamber 12*a* of the backpass volume 12. As the superheat steam flows through the finishing superheater 34, a transfer of heat takes place between the relatively cool superheat steam and the hot flue gases 30 that, as has been described herein previously, flow through the first chamber 12*a*. Upon exiting from the finishing superheater 34 the final superheat steam now being at a predefined final superheat outlet steam temperature is in a highly superheated state and is made to flow by means of a piping link, denoted in FIG. 5 by the reference numeral 90', to the high pressure turbine 50.

Within the high pressure turbine 50, the superheat steam is made to flow by means of a piping link, denoted in FIG. 5 by the reference numeral 52, from the high pressure turbine 50 to a reheat spray desuperheater, denoted in FIG. 5 by the reference numeral 48*a,* and then by means of a piping link, denoted in FIG. 5 by the reference numeral 52', to the reheater, denoted in FIG. 5 by the reference numeral 36, which is located within the second chamber 12*b* of the backpass volume 12. In the reheater 36 a transfer of heat takes place between the relatively cool superheat steam and the relatively hot flue gases 30 that flow through the second chamber 12*b,* to which reference has been had herein previously, whereby the superheat steam is further superheated. Upon exiting from the reheater 36 the final reheat steam now being at a predefined final reheat outlet steam temperature is still in a highly superheated state and is made to flow via a piping link, denoted in FIG. 5 by the reference numeral 54, to the low pressure turbine 60. Within the low pressure turbine 60 the final reheat steam in known fashion undergoes further expansion. Thereafter, the now saturated steam is made to flow by means of a piping link, denoted in FIG. 5 by the reference numeral 62, to a condenser, denoted in FIG. 5 by the reference numeral 70, wherein the saturated steam is condensed to feedwater. The feedwater is then made to flow by means of the piping link, denoted in FIG. 5 by the reference numerals 72, 82, and by means of the feedpump, denoted in FIG. 5 by the reference numeral 80, from the condenser 70 to the first economizer surface 38*a,* which is located in the first chamber 12*a* of the backpass volume 12, and to the second economizer surface 38*b,* which is located within the second chamber 12*b* of the backpass volume 12. A transfer of heat takes place within the economizer surface 38*a* between the relatively cool feedwater flowing therethrough and the still relatively hot flue gases 30 that flow through the first chamber 12*a,* to which reference has been had herein previously, and within the economizer surface 38*b* between the relatively cool feedwater flowing therethrough and the still relatively hot flue gases that flow through the second chamber 12*b,* to which reference has been had herein previously. From the first economizer surface 38*a* and the second economizer surface 38*b* the feedwater, which is now in a saturated state, is made to flow by means of a piping link, denoted in FIG. 5 by the reference numeral 84, to the steam drum 40 thereby completing the circulatory fluid flow path in accordance with the present invention of the thermodynamic steam cycle 300.

In addition to the control exercised over the superheat steam and the reheat steam, which has been described hereinbefore, it is possible in accordance with the present invention to effect further control over the outlet temperature of the final superheat steam and over the outlet temperature of the final reheat steam. To this end, such further control over the outlet temperature of the final superheat steam and over the outlet temperature of the final reheat steam is effected, in accordance with the present invention, through manipulation, either separately or in combination, of the suspension density of the hot solids 32 within the furnace volume 4 and of the extent to which the flue gases 30 are distributed between the first chamber 12*a* and the second chamber 12*b* of the backpass volume 12. More specifically, as will be best understood with reference to FIG. 7 of the drawing, if the profile of the suspension density of the hot solids 32 within the furnace volume 4 is shifted as a result of the ratio of primary air 26 to secondary air 28 being increased, this will result in more hot solids 32 rising within the furnace volume 4 to the upper segment thereof. As such, within the upper segment of the furnace volume 4 there will be more energy available to be transferred from the hot combustion gases 30 with which the hot solids 32 are entrained to the saturated steam, which flows into the low temperature superheater 34*a*. In turn, this will cause the temperature of the superheat steam, which is made to flow to the backpass volume 12, to rise. Conversely, if the ratio of primary air 26 to secondary air 28 is decreased, this will result in fewer hot solids 32 rising within the furnace volume 4 to the upper segment thereof. In turn, this will result in a decrease in the temperature of the superheat steam, which is made to flow from the low temperature superheater 34*a* to the backpass volume 12.

Consideration will next be had herein to the matter of the distribution of the flue gases 30 between the first chamber 12*a* and the second chamber 12*b* of the backpass volume 12. Such distribution in accordance with the preferred embodiment of the invention is effected through manipulation of the first set of dampers 13*a,* which as has been described herein previously is suitably mounted for movement between an open and a closed position at the exit end of the first chamber 12*a,* as well as through manipulation of the second set of dampers 13*b,* which as has been described herein previously is suitably mounted for movement between an open and a closed position at the exit end of the second chamber 12*b*. To this end, through manipulation of the first set of dampers 13*a* and of the second set of dampers 13*b,* the flue gases 30 may be made to flow to a greater or to a lesser extent through either the first chamber 12*a* or the second chamber 12*b*. Consequently, depending upon the extent to which the flue gases 30 are apportioned between the first chamber 12*a* and the second chamber 12*b,* more or less energy, i.e., more or less heat, will be available to be transferred from the flue gases 30 to the finishing superheater 34 and the first economizer surface 38*a,* which are located within the first chamber 12*a* of the backpass volume 12, or to the reheater 36 and the second economizer surface 38*b,* which are located within the second chamber 12*b* of the backpass volume 12. Namely, if the flue gases 30 are directed to a greater extent to the first chamber 12*a* than they are to the second chamber 12*b,* this will result in an increase in the outlet temperature of the final superheat steam and concomitantly a decrease in the outlet temperature of the final reheat steam. Conversely, if the flue gases 30 are directed to a greater extent to the second chamber 12*b* than they are to the first chamber 12*a,* this will result in an increase in the outlet temperature of the final reheat steam, which is made to flow to the low pressure turbine 60, and concomitantly a decrease in the outlet temperature of the final superheat steam, which is made to flow to the high pressure turbine 50.

Figure 6:
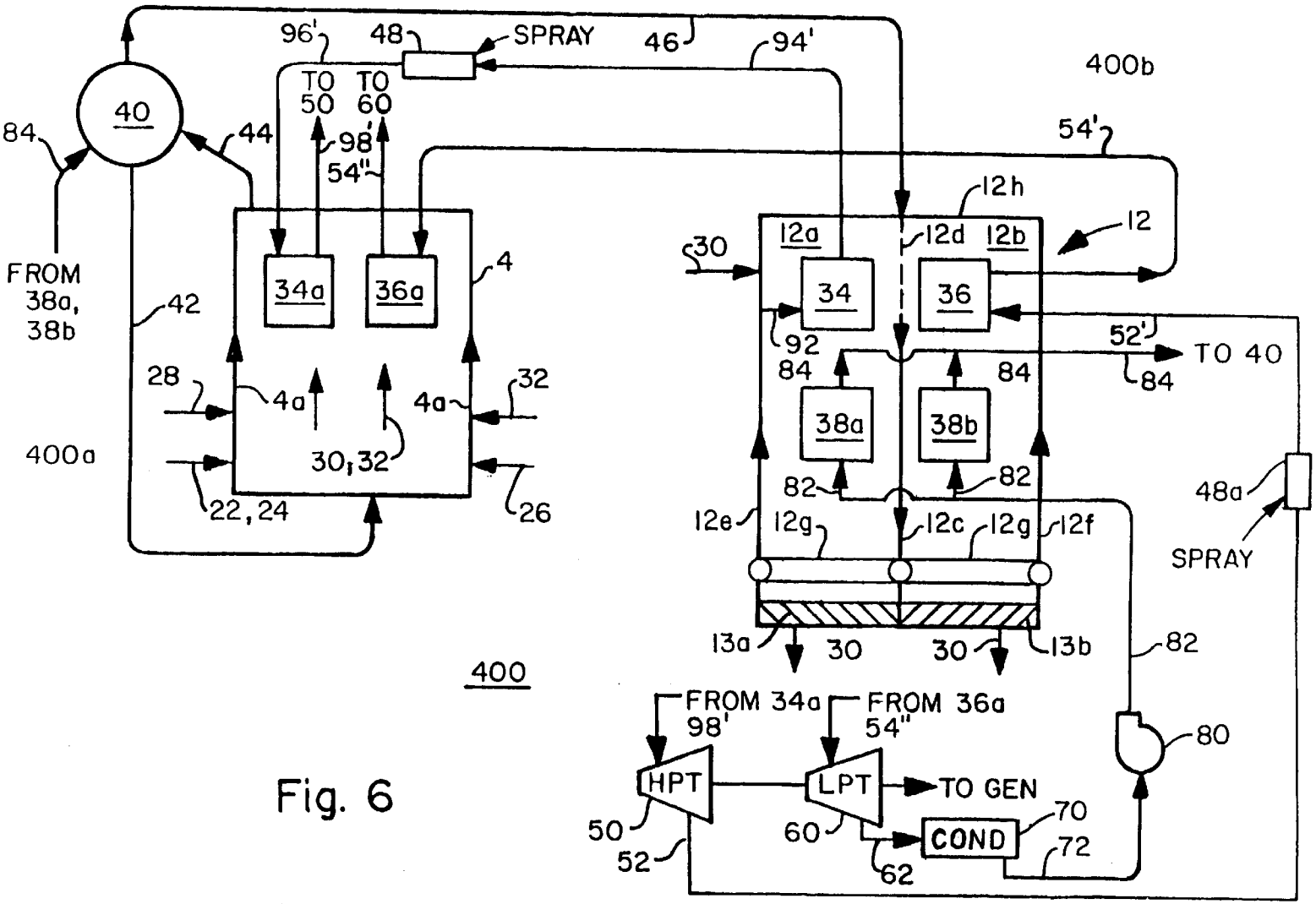
FIG. 6 is a simplified schematic representation of a fourth embodiment of the fluid circuitry of the thermodynamic steam cycle employable with a circulating fluidized bed steam generator (CFB) such as the circulating fluidized bed steam generator (CFB) illustrated in FIG. 1, constructed in accordance with the present invention.

A description will next be had herein of the thermodynamic steam cycle 400, which is illustrated in FIG. 6 of the drawing. For purposes of the description that follows hereinafter of the thermodynamic steam cycle 400 of the circulating fluidized bed steam generator (CFB) 2, note is made here of the fact that the fluid flow circuitry of the thermodynamic steam cycle 400 encompasses a multiplicity of downcomers, risers, tubes, headers, piping links, etc. through which water and steam as necessary are made to flow in accordance with the requirements as determined by the nature of the thermodynamic steam cycle 400. As will be best understood with reference to FIG. 6 of the drawing, the thermodynamic steam cycle 400 is comprised of a first circulatory fluid flow path, denoted therein by the reference numeral 44*a,* and a second circulatory fluid flow path, denoted therein by the reference numeral 400*b*. With further reference thereto, the first circulatory fluid flow path 400*a* is designed to be operative as an evaporative steam loop, denoted in FIG. 6 by the reference numerals 40, 42, 4*a,* 44, 40. The second circulatory fluid flow path 400*b,* on the other hand, is designed to be operative as a superheat steam-reheat steam loop. To this end, the superheat steam-reheat steam loop includes a saturated steam segment, denoted in FIG. 6 by the reference numerals 46, 12*c,* 12*g,* 12*e,* 12*f,* 12*h,* 92, a superheat steam segment, denoted in FIG. 6 by the reference numerals 34, 94', 48, 96', 34*a,* 98', 50, 52, 48*a,* 52', a reheat steam segment, denoted in FIG. 6 by the reference numerals 36, 54', 36*a,* 54", 60, 62, and an economizer segment, denoted in FIG. 6 by the reference numerals 70, 72, 80, 82, 38*a,* 84, 40.

The evaporative steam loop 40, 42, 4*a,* 44, 40 becomes operative as a function of the combustion process, which takes place within the furnace volume 4. As has been noted herein previously, as the hot combustion gases 30 with the hot solids 32 entrained therewith rise within the furnace volume 4 heat is transferred therefrom to the waterwall tubes 4*a,* which serve to define the furnace volume 4. As a consequence thereof, the saturated water, which enters the waterwall tubes 4*a* from the steam drum, denoted in FIG. 6 by the reference numeral 40, is evaporatively changed to a mixture of saturated water and saturated steam as the saturated water, which has entered the waterwall tubes 4*a* from the steam drum 40, rises within the waterwall tubes 4*a*. Thereafter, this mixture of saturated water is made to flow via a riser, denoted in FIG. 6 by the reference numeral 44, to the steam drum 40 for separation. After separation in the steam drum 40, the saturated water is once again made to flow to the lower segment of the waterwall tubes 4*a* via the downcomer 42 whereas after separation in the steam drum 40 the saturated steam is made to flow to the vertical partition 12*c* via a piping link, denoted in FIG. 6 by the reference numeral 46, and a common header (not shown in the interest of maintaining clarity of illustration in the drawing).

Continuing, the saturated steam, which is made to flow to the vertical partition 12*c,* is then caused to circulate through the backpass volume 12. More specifically, the saturated steam circulates through the vertical partition 12*c,* a lower ring header, denoted in FIG. 6 by the reference numeral 12*g,* the front wall 12*e,* the back wall 12*f,* and the roof 12*h*. In the course of such circulation through the backpass volume 12, the saturated steam is operative to effect therewith a cooling thereof, i.e., a cooling of the vertical partition 12*c,* the front wall 12*e,* the back wall 12*f,* and the roof 12*h*. Although the aforesaid cooling has been described above as being accomplished through the use of steam, it is to be understood that such cooling could also be accomplished, without departing from the essence of the present invention, through the use of water. After the saturated steam has circulated through the backpass volume 12 in the aforedescribed manner, the saturated steam is then made to flow via a piping link, denoted in FIG. 6 by the reference numeral 92, to a low temperature superheater, denoted in FIG. 6 by the reference numeral 34, suitably located for this purpose in the upper segment of the first chamber 12*a*. As the saturated steam flows through the low temperature superheater 34 a transfer of heat takes place between the relatively cool saturated steam and the relatively hot flue gases 30 that are made to flow through the first chamber 12*a*. The saturated steam, which exits by means of a piping link, denoted in FIG. 6 by the reference numeral 94', from the low temperature superheater 34, is now in a superheated state. In accordance with the best mode embodiment of the invention, control over the temperature of the superheat steam exiting from the low temperature superheater is effected through the use of a superheat spray desuperheater, denoted in FIG. 6 by the reference numeral 48.

As will be readily understood from a reference to FIG. 6 of the drawing, from the superheat spray desuperheater 48 the still superheated steam flows via a piping link, denoted in FIG. 6 by the reference numeral 96' to the finishing superheater 34*a* that is suitably located for this purpose within the upper segment of the furnace volume 4. In the finishing superheater 34*a* a transfer of heat takes place between the relatively cool superheat steam and the relatively hot combustion gases 30 with the hot solids 32 entrained therewith as the hot combustion gases 30 with the hot solids 32 entrained therewith rise within the furnace volume 4, to which reference has been had herein previously, whereby the superheat steam is further superheated. Upon exiting from the finishing superheater 34*a* the final superheat steam now being at a predefined final superheat outlet steam temperature is in a highly superheated state and is made to flow by means of a piping link, denoted in FIG. 6 by the reference numeral 98' to the high pressure turbine 50.

Within the high pressure turbine 50 the final superheat steam in known fashion undergoes expansion. Thereafter, the superheat steam is made to flow by means of a piping link, denoted in FIG. 6 by the reference numeral 52, from the high pressure turbine 50 to a reheat spray desuperheater 48*a,* and then by means of a piping link, denoted in FIG. 6 by the reference numeral 52', to a low temperature reheater 36, which is suitably located for this purpose within the second chamber 12*b* of the backpass volume 12. In the low temperature reheater 36 a transfer of heat takes place between the relatively cool yet still superheated steam and the still relatively hot flue gases 30 that flow through the second chamber 12*b,* to which reference has been had herein previously. Upon exiting from the low temperature superheater 36 the superheat steam is made to flow via a piping link, denoted in FIG. 6 by the reference numeral 54', to a finishing reheater, denoted in FIG. 6 by the reference numeral 36*a,* suitably located for this purpose in the upper segment of the furnace volume 4. Within the finishing reheater 36*a,* a transfer of heat takes place between the relatively cool superheat steam and the relatively hot combustion gases 30 with the hot solids 32 entrained therewith as the hot combustion gases 30 with the hot solids 32 entrained therewith rise within the furnace volume 4, to which reference has been had herein previously. Upon exiting from the finishing reheater 36*a* the final reheat steam now being at a predefined final reheat outlet steam temperature is still in a highly superheated state and is made to flow by means of a piping link, denoted in FIG. 6 by the reference numeral 54', to the low pressure turbine 60. Within the low pressure turbine 60 the final reheat steam in known fashion undergoes expansion. Thereafter, the now saturated steam is made to flow by means of a piping link, denoted in FIG. 6 by the reference numeral 62, to a condenser, denoted in FIG. 6 by the reference numeral 70, wherein the saturated water is condensed to feedwater. The feedwater is then made to flow by means of the piping link, denoted in FIG. 6 by the reference numerals 72, 82, and by means of the feedpump, denoted in FIG. 6 by the reference numeral 80, from the condenser 70 to the first economizer surface 38*a,* which is located in the first chamber 12*a* of the backpass volume 12, and to the second economizer surface 38*b,* which is located within the second chamber 12*b* of the backpass volume 12. Within the first economizer surface 38*a* and the second economizer surface 38*b* a transfer of heat takes place between the relatively cool feedwater and the still relatively hot flue gases 30 that flow through the first chamber 12*a* and the second chamber 12*b,* respectively. From the first economizer surface 38*a* and the second economizer surface 38*b* the feedwater, which is now in a saturated state, is made to flow by means of a piping link, denoted in FIG. 6 by the reference numeral 84, to the steam drum 40 thereby completing the circulatory fluid flow path in accordance with the present invention of the thermodynamic steam cycle 400.

In addition to the control exercised over the superheat steam and the reheat steam, which has been described hereinbefore, it is possible in accordance with the present invention to effect further control over the outlet temperature of the final superheat steam and over the outlet temperature of the final reheat steam. To this end, such further control over the outlet temperature of the final superheat steam and over the outlet temperature of the final reheat steam is effected, in accordance with the present invention, through manipulation, either separately or in combination, of the suspension density of the hot solids 32 within the furnace volume 4 and of the extent to which the flue gases 30 are distributed between the first chamber 12*a* and the second chamber 12*b* of the backpass volume 12. More specifically, as will be best understood with reference to FIG. 7 of the drawing, if the profile of the suspension density of the hot solids 32 within the furnace volume 4 is shifted as a result of the ratio of primary air 26 to secondary air 28 being increased, this will result in more hot solids 32 rising within the furnace volume 4 to the upper segment thereof. As such, within the upper segment of the furnace volume 4 there will be more energy available to be transferred from the hot combustion gases 30 with which the hot solids 32 are entrained to the superheat steam entering the finishing superheater 34*a* and the reheat steam entering the finishing reheater 36*a*. In turn this will cause the temperature of the final superheat steam, which is made to flow to the high pressure turbine 50, as well as the temperature of the final reheat steam, which is made to flow to the low pressure turbine 60, to rise. Conversely, if the ratio of primary air 26 to secondary air 28 is decreased, this will result in fewer hot solids 32 rising within the furnace volume 4 to the upper segment thereof thereby causing the temperature of the final superheat steam, which is made to flow to the high pressure turbine 50, as well as the temperature of the final reheat steam, which is made to flow to the low pressure turbine 60, to decrease.

Consideration will next be had herein to the matter of the distribution of the flue gases 30 between the first chamber 12*a* and the second chamber 12*b* of the backpass volume 12. Such distribution in accordance with the preferred embodiment of the invention is effected through manipulation of the first set of dampers 13*a,* which as has been described herein previously is suitably mounted for movement between an open and a closed position at the exit end of the first chamber 12*a,* as well as through manipulation of the second set of dampers 13*b,* which as has been described herein previously is suitably mounted for movement between an open and a closed position at the exit end of the second chamber 12*b*. To this end, through manipulation of the first set of dampers 13*a* and of the second set of dampers 13*b,* the flue gases 30 may be made to flow to a greater or lesser extent through either the first chamber 12*a* or the second chamber 12*b*. Consequently, depending upon the extent to which the flue gases 30 are apportioned between the first chamber 12*a* and the second chamber 12*b*, more or less energy, i.e., more or less heat, will be available to be transferred from the flue gases 30 to the low temperature superheater 34 and the first economizer surface 38*a*, which are located within the first chamber 12*a* of the backpass volume 12, or to the low temperature reheater 36 and the second economizer surface 38*b*, which are located within the second chamber 12*b* of the backpass volume 12. Namely, if the flue gases 30 are directed to a greater extent to the first chamber 12*a* than they are to the second chamber 12*b*, this will result in an increase in the temperature of the superheat steam exiting from the low temperature superheater 34. Thus, under fixed conditions in the furnace volume 4, this in turn will result in an increase in the outlet temperature of the final superheat steam that is made to flow to the high pressure turbine 50. In addition, with a greater proportion of the distribution of the flue gases 30 being directed to the first chamber 12*a* there is a concomitant decrease in the temperature of the reheat steam exiting from the low temperature reheater 36. Therefore, under fixed conditions in the furnace volume 4 this in turn will result in a decrease in the outlet temperature of the final reheat steam that is made to flow to the low pressure turbine 60. Conversely, if a greater proportion of the distribution of the flue gases 30 is directed to the second chamber 12*b*, this will result in an increase in the temperature of the reheat steam exiting from the low temperature reheater 36. Thus, under fixed conditions within the furnace volume 4, this in turn will result in an increase in the outlet temperature of the final reheat steam that is made to flow to the low pressure turbine 60. Also, with a greater proportion of the distribution of the flue gases 30 being directed to the second chamber 12*b* there is a concomitant decrease in the temperature of the superheat steam exiting from the low temperature superheater 34. Therefore, under fixed conditions within the furnace volume 4, this in turn will result in a decrease in the outlet temperature of the final superheat steam that is made to flow to the high pressure turbine 50.

Thus, in accordance with the present invention there has been provided a new and improved method for controlling the final superheat outlet steam temperature and the final reheat outlet steam temperature of a circulating fluidized bed steam generator (CFB). Besides, there has been provided in accord with the present invention such a new and improved method for controlling the final superheat outlet steam temperature and the final reheat outlet steam temperature of a circulating fluidized bed steam generator (CFB) wherein the circulating fluidized bed steam generator (CFB) embodies a furnace volume having therewithin heat transfer surface. Moreover, in accordance with the present invention there has been provided such a new and improved method for controlling the final superheat outlet steam temperature and the final reheat outlet steam temperature of a circulating fluidized bed steam generator (CFB) wherein the circulating fluidized bed steam generator (CFB) embodies a backpass volume having therewithin heat transfer surface. Also, there has been provided in accord with the present invention such a new and improved method for controlling the final superheat outlet steam temperature and the final reheat outlet steam temperature of a circulating fluidized bed steam generator (CFB) wherein the circulating fluidized bed steam generator (CFB) embodies both a furnace volume having therewithin heat transfer surface and a backpass volume having therewithin heat transfer surface. Further, in accordance with the present invention there has been provided such a new and improved method for controlling the final superheat outlet steam temperature and the final reheat outlet steam temperature of a circulating fluidized bed steam generator (CFB) wherein the need to employ one or more fluidized bed heat exchangers in order to perform heat transfer duty therewith is obviated. In addition, there has been provided in accord with the present invention such a new and improved method for controlling the final superheat outlet steam temperature and a final reheat outlet steam temperature of a circulating fluidized bed steam temperature (CFB) wherein such control is effected as a consequence of the manipulation of the suspension density of the solids within the furnace volume of the circulating fluidized bed steam generator (CFB). Penultimately, in accordance with the present invention there has been provided such a new and improved method for controlling the final superheat outlet steam temperature and the final reheat outlet steam temperature of a circulating fluidized bed steam generator (CFB) wherein such control is effected as a consequence of the manipulation of the flue gas stream within the backpass volume of the circulating fluidized bed steam generator (CFB). Finally, there has been provided in accord with the present invention such a new and improved method for controlling the final superheat outlet steam temperature and the final reheat outlet steam temperature of a circulating fluidized bed steam generator (CFB) wherein such control is effected both as a consequence of the manipulation of the suspension density of the solids within the furnace volume of the circulating fluidized bed steam generator (CFB) and as a consequence of the manipulation of the flue gas stream within the backpass volume of the circulating fluidized bed steam generator (CFB).

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. In a steam generation plant including a high pressure turbine, a low pressure turbine and a circulating fluidized bed steam generator having a furnace volume defined by a plurality of waterwall tubes and embodying therewithin at least superheat surface, a multichambered backpass volume connected in fluid flow relation with the furnace volume and embodying in one chamber thereof at least superheat surface and embodying in another chamber thereof at least reheat surface, a first circulatory fluid flow path operative as an evaporative steam loop, and a second circulatory fluid flow path operative as a superheat steam-reheat steam loop and having a saturated steam segment, a superheat steam segment, a reheat steam segment and an economizer segment, the improvement of a method for exercising control over the final predefined superheat outlet steam temperature from the circulating fluidized bed steam generator and for exercising control over the final predefined reheat outlet steam temperature from the circulating fluidized bed steam generator, said method for exercising control over the final predefined superheat outlet steam temperature from the circulating fluidized bed steam generator and for exercising control over the final predefined reheat outlet steam temperature from the circulating fluidized bed steam generator comprising the steps of:

a. effecting the flow of saturated water within the waterwall tubes defining the furnace volume;

b. effecting the combustion of fuel and air within the furnace volume so as to thereby produce therefrom hot gases and solids;

c. effecting a heat transfer from the hot gases produced from the combustion of fuel and air within the furnace volume to the saturated water flowing within the waterwall tubes defining the furnace volume so as to thereby produce from such heat transfer a mixture of saturated water and saturated steam within the waterwall tubes defining the furnace volume;

d. effecting the separation of the saturated water from the mixture of saturated water and saturated steam after the mixture of saturated water and saturated steam has flowed through the waterwall tubes defining the furnace volume and thereafter effecting the return of the separated saturated water to the waterwall tubes defining the furnace volume;

e. effecting the separation of the saturated steam from the mixture of saturated water and saturated steam after the mixture of saturated water and saturated steam has flowed through the waterwall tubes defining the furnace volume and thereafter effecting the flow of the separated saturated steam to and through the multichambered backpass volume;

f. effecting the flow of the separated saturated steam from the multichambered backpass volume to and through a low temperature superheat surface and during the passage therethrough of the separated saturated steam effecting the heating of the separated saturated steam to a temperature sufficient to transform the separated saturated steam to superheat steam;

g. effecting the flow of the superheat steam from the low temperature superheat surface to and through a finishing superheat surface and during the passage therethrough of the superheat steam effecting the heating of the superheat steam to a final predefined superheat outlet steam temperature;

h. effecting the flow of the superheat steam having a final predefined superheat outlet steam temperature from the finishing superheat surface to and through the high pressure turbine and during the passage therethrough of the superheat steam effecting the expansion thereof;

i. effecting the flow of the superheat steam from the high pressure turbine to and through a reheat surface and during the passage therethrough of the superheat steam effecting the heating of the superheat steam to a final predefined reheat outlet steam temperature;

j. effecting the flow of the superheat steam having a final predefined reheat outlet steam temperature from the reheat surface to and through a low pressure turbine and during the passage therethrough of the superheat steam effecting the expansion thereof such that the superheat steam is transformed to saturated steam; and k. effecting the exercise of control over the predefined superheat outlet steam temperature and the exercise of control over the predefined reheat outlet steam temperature by manipulating the suspension density within the furnace volume of the solids produced from the combustion of fuel and air within the furnace volume.

2. In a steam generation plant, the method for exercising control over the final predefined superheat outlet steam temperature and for exercising control over the final predefined outlet steam temperature as set forth in claim 1 wherein:

a. the flow of the separated saturated steam is effected to a low temperature superheat surface located within the furnace volume;

b. the flow of the superheat steam is effected from the low temperature superheat surface to a finishing superheat surface located within the one chamber of the multichambered backpass volume; and c. the flow of the superheat steam is effected from the high pressure turbine to a reheat surface located within the another chamber of the multichambered backpass volume.

3. In a steam generation plant, the method for exercising control over the predefined superheat outlet steam temperature and for exercising control over the final reheat outlet steam temperature as set forth in claim 2 further comprising the step of effecting the condensing of the saturated steam from the low pressure turbine to feedwater and thereafter effecting the flow of the feedwater to a first economizer surface located within the one chamber of the multichambered backpass volume and to a second economizer surface located within the another chamber of the multichambered backpass volume.

4. In a steam generation plant, the method for exercising control over the predefined superheat outlet steam temperature and for exercising control over the final reheat outlet steam temperature as set forth in claim 1 wherein:

a. the flow of the separated saturated steam is effected to a low temperature superheat surface located within the one chamber of the multichambered backpass volume;

b. the flow of the superheat steam is effected from the low temperature superheat surface to a finishing superheat surface located within the furnace volume; and c. the flow of the superheat steam is effected from the high pressure turbine to a reheat surface located within the another chamber of the multichambered backpass volume.

5. In a steam generation plant, the method for exercising control over the final predefined superheat outlet steam temperature and for exercising over the final predefined reheat outlet steam temperature as set forth in claim 4 further comprising the step of effecting the condensing of the saturated steam from the low pressure turbine to feedwater and thereafter effecting the flow of the feedwater to a first economizer surface located within the one chamber of the multichambered backpass volume and to a second economizer surface located within the another chamber of the multichambered backpass volume.

6. In a steam generation plant, the method for exercising control over the final predefined superheat outlet steam temperature and for exercising control over the final predefined reheat outlet steam temperature as set forth in claim 1 wherein the flow of the separated saturated steam is effected to a low temperature superheat surface located within the one chamber of the multichambered backpass volume, the flow of the superheat steam is effected from the low temperature superheat surface to a finishing superheat surface located within the furnace volume, and the flow of the superheat steam is effected from the high pressure turbine to a low temperature reheat surface located within the another chamber of the multichambered backpass volume, and further comprising the step of effecting the flow of the superheat steam from the low temperature reheat surface to a finishing reheat surface located within the furnace volume.

7. In a steam generation plant, the method for exercising control over the final predefined superheat outlet steam temperature and for exercising control over the final predefined reheat outlet steam temperature as set forth in claim 6 further comprising the step of effecting the condensing of the saturated steam from the low pressure turbine to feedwater and thereafter effecting the flow of the feedwater to a first economizer surface located within the one chamber of the multichambered backpass volume and to a second economizer surface located within the another chamber of the multichambered backpass volume.

8. In a steam generation plant including a high pressure turbine, a low pressure turbine and a circulating fluidized bed steam generator having a furnace volume defined by a plurality of waterwall tubes and embodying therewithin at least superheat surface, a multichambered backpass volume connected in fluid flow relation with the furnace volume and embodying in one chamber thereof at least superheat surface and in another chamber thereof at least reheat surface, a first circulatory fluid flow path operative as an evaporative steam loop, and a second circulatory fluid flow path operative as a superheat steam-reheat steam loop and having a saturated steam segment, a superheat steam segment, a reheat steam segment and an economizer segment, the improvement of a method for exercising control over the final predefined superheat outlet steam temperature and for exercising control over the final reheat outlet steam temperature, said method for exercising control over the final predefined superheat outlet steam temperature and over the final reheat outlet steam temperature comprising the steps of:

a. effecting the flow of saturated water within the waterwall tubes defining the furnace volume;

b. effecting the combustion of fuel and air within the furnace volume so as to thereby produce hot gases and solids therefrom;

c. effecting a heat transfer from the hot gases produced from the combustion of fuel and air within the furnace volume to the saturated water flowing within the waterwall tubes defining the furnace volume so as to thereby produce from such heat transfer a mixture of saturated water and saturated steam within the waterwall tubes defining the furnace volume;

d. effecting the separation of the saturated water from the mixture of saturated water and saturated steam after the mixture of saturated water and saturated steam has flowed through the waterwall tubes defining the furnace volume and thereafter effecting the return of the separated saturated water to the waterwall tubes defining the furnace volume;

e. effecting the separation of the saturated steam from the mixture of saturated water and saturated steam after the mixture of saturated water and saturated steam has flowed through the waterwall tubes defining the furnace volume and thereafter effecting the flow of the separated saturated steam to and through the multichambered backpass volume;

f. effecting the flow of the separated saturated steam from the multichambered backpass volume to and through a low temperature superheat surface and during the passage of the separated saturated steam therethrough effecting the heating of the separated saturated steam to a sufficient temperature to transform the separated saturated steam to superheat steam;

g. effecting the flow of the superheat steam from the low temperature superheat surface to and through a finishing superheat surface and during the passage therethrough of the superheat steam effecting the heating of the superheat steam to a final predefined superheat outlet steam temperature;

h. effecting the flow of the superheat steam having a final predefined superheat outlet steam temperature from the finishing superheat surface to and through a high pressure turbine and during the passage therethrough of the superheat steam effecting the expansion thereof;

i. effecting the flow of the superheat steam from the high pressure turbine to and through a reheat surface and during the passage therethrough of the superheat steam effecting the heating of the superheat steam to a final predefined reheat outlet temperature;

j. effecting the flow of the superheat steam having a final reheat outlet steam temperature from the reheat surface to and through a low pressure turbine and during the passage therethrough of the superheat steam effecting the expansion thereof;

k. effecting the flow of the hot gases from the furnace volume to and through the one chamber of the multichambered backpass volume and to and through the another chamber of the multichambered backpass volume; and l. effecting the exercise of control over the final predefined superheat outlet steam temperature and the exercise of control over the final predefined reheat outlet steam temperature by manipulating the apportionment of the flow of hot gases between the one chamber of the multichambered backpass volume and the another chamber of the multichambered backpass volume.

9. In a steam generation plant, the method for exercising control over the final predefined superheat outlet steam temperature and for exercising control over the final predefined reheat outlet steam temperature as set forth in claim 8 wherein:

a. the flow of the separated saturated steam is effected to a low temperature superheat surface located within the furnace volume;

b. the flow of the superheat steam is effected from the low temperature superheat surface to a finishing superheat surface located within the one chamber of the multichambered backpass volume; and c. the flow of the superheat steam is effected from the high pressure turbine to a reheat surface within the another chamber of the multichambered backpass volume.

10. In a steam generation plant, the method for exercising control over the final predefined superheat outlet steam temperature and for exercising control over the final predefined reheat outlet steam temperature as set forth in claim 9 further comprising the step of effecting the condensing of the saturated steam from the low pressure turbine to feedwater and thereafter effecting the flow of the feedwater to a first economizer surface located within the one chamber of the multichambered backpass volume and to a second economizer surface located within the another chamber of the multichambered backpass volume.

11. In a steam generation plant, the method for exercising control over the final predefined superheat outlet steam temperature and for exercising control over the final reheat outlet steam temperature as set forth in claim 8 wherein:

a. the flow of the separated saturated steam is effected to a low temperature superheat surface located within the one chamber of the multichambered backpass volume;

b. the flow of the superheat steam is effected from the low temperature superheat surface to a finishing superheat surface located within the furnace volume; and c. the flow of the superheat steam is effected from the high pressure turbine to a reheat surface located within the another chamber of the multichambered backpass volume.

12. In a steam generation plant, the method for exercising control over the final predefined superheat outlet steam temperature and for exercising control over the final predefined reheat outlet steam temperature as set forth in claim 11 further comprising the step of effecting the condensing of the saturated steam from the low pressure turbine to feedwater and thereafter effecting the flow of the feedwater to a first economizer surface located within the one of the multichambered backpass volume and to a second economizer surface located within the multichambered backpass volume.

13. In a steam generation plant, the method for exercising control over the final predefined superheat outlet steam temperature and for exercising control over the final predefined reheat outlet steam temperature as set forth in claim 8 wherein the flow of the separated saturated steam is effected to a low temperature superheat surface located within the one chamber of the multichambered backpass volume, the flow of the superheat steam is effected from the low temperature superheat surface to a finishing superheat surface located within the furnace volume, and the flow of the superheat surface is effected from the high pressure turbine to a low temperature reheat surface located within the another chamber of the multichambered backpass volume, and further comprising the step of effecting the flow of the superheat steam from the low temperature reheat surface to a finishing reheat surface located within the furnace volume.

14. In a steam generation plant, the method for exercising control over the final predefined superheat outlet steam temperature and for exercising control over the final reheat outlet steam temperature as set forth in claim 13 further comprising the step of effecting the condensing of the saturated steam from the low pressure turbine to feedwater and thereafter effecting the flow of the feedwater to a first economizer surface located within the one chamber of the multichambered backpass volume and to a second economizer surface located within the another chamber of the multichambered backpass volume.

15. In a steam generation plant including a high pressure turbine, a low pressure turbine and a circulating fluidized bed steam generator having a furnace volume defined by a plurality of waterwall tubes and embodying therewithin at least superheat surface, a multichambered backpass volume connected in fluid flow relation with the furnace volume and embodying in one chamber thereof at least superheat surface and in another chamber thereof at least reheat surface, a first circulatory fluid flow path operative as an evaporative steam loop, and a second circulatory fluid flow path operative as a superheat steam-reheat steam loop and having a saturated steam segment, a superheat steam segment, a reheat steam segment and an economizer segment, the improvement of a method for exercising control over the final predefined superheat outlet steam temperature from the circulating fluidized bed steam generator and for exercising control over the final predefined reheat outlet steam temperature from the circulating fluidized bed steam generator, said method for exercising control over the final predefined superheat outlet steam temperature and for exercising control over the final predefined reheat outlet steam temperature comprising the steps of:

a. effecting the flow of saturated water within the waterwall tubes defining the furnace volume;

b. effecting the combustion of fuel and air within the furnace volume so as to thereby produce hot gases and solids therefrom;

c. effecting a heat transfer from the hot gases produced from the combustion of fuel and air within the furnace volume to the saturated water flowing within the waterwall tubes defining the furnace volume so as to thereby produce from such heat transfer a mixture of saturated water and saturated steam within the waterwall tubes defining the furnace volume;

d. effecting the separation of the saturated water from the mixture of saturated water and saturated steam after the mixture of saturated water and saturated steam has flowed through the waterwall tubes defining the furnace volume and thereafter effecting the return of the separated saturated water to the waterwall tubes defining the furnace volume;

e. effecting the separation of the saturated steam from the mixture of saturated water and saturated steam after the mixture of saturated water and saturated steam has flowed through the waterwall tubes defining the furnace volume and thereafter effecting the flow of the separated saturated steam to and through the multichambered backpass volume;

f. effecting the flow of the separated saturated steam from the multichambered backpass volume to and through a low temperature superheat surface and during the passage therethrough of the separated saturated steam effecting the heating of the separated saturated steam to a temperature sufficient to transform the separated saturated steam to superheat steam;

g. effecting the flow of the superheat steam from the low temperature superheat surface to and through a finishing superheat surface and during the passage therethrough of the superheat steam effecting the heating of the superheat steam to a final predefined superheat outlet steam temperature;

h. effecting the flow of the superheat steam having a final predefined superheat outlet steam temperature from the finishing superheat surface to and through a high pressure turbine and during the passage therethrough of the superheat steam effecting the expansion thereof;

i. effecting the flow of the superheat steam from the high pressure turbine to and through a reheat surface and during the passage therethrough of the superheat steam effecting the heating thereof to a final predefined reheat outlet steam temperature;

j. effecting the flow of the superheat steam having a final reheat outlet steam temperature to a low pressure turbine and during the passage therethrough of the superheat steam effecting the expansion thereof;

k. effecting the flow of the hot gases from the furnace volume to the one chamber of the multichambered backpass volume and to the another chamber of the multichambered backpass volume; and l. effecting the exercise of control over the final predefined superheat outlet steam temperature and the exercise of control over the final reheat outlet steam temperature by manipulating the suspension density within the furnace volume of the solids produced from the combustion of fuel and air within the furnace volume and by manipulating the apportionment of the flow of the hot gases between the one chamber of the multichambered backpass volume and the another chamber of the multichambered backpass volume.

16. In a steam generation plant, the method for exercising control over the final superheat outlet steam temperature and for exercising control over the final predefined reheat outlet steam temperature as set forth in claim 15 wherein:

a. the flow of the separated saturated steam is effected to a low temperature superheat surface located within the furnace volume;

b. the flow of the superheat steam from the low temperature superheat surface is effected to a finishing superheat surface located within the one chamber of the multichambered backpass volume; and c. the flow of the superheat steam is effected from the high pressure turbine to a reheat surface located within the another chamber of the multichambered backpass volume.

17. In a steam generation plant, the method for exercising control over the final predefined superheat outlet steam temperature and for exercising control over the final reheat outlet steam temperature as set forth in claim 16 further comprising the step of condensing the saturated steam from the low pressure turbine to feedwater and thereafter effecting the flow of the feedwater to a first economizer surface located within the one chamber of the multichambered backpass volume and to a second economizer surface located within the another chamber of the multichambered backpass volume.

18. In a steam generation plant, the method for exercising control over the final predefined superheat outlet steam temperature and for exercising control over the final predefined reheat outlet steam temperature as set forth in claim 15 wherein:

a. the flow of the separated saturated steam is effected to a low temperature superheat surface located within the one chamber of the multichambered backpass volume;

b. the flow of the superheat steam is effected from the low temperature superheat surface to a finishing superheat surface located within the furnace volume; and c. the flow of the superheat steam is effected from the high pressure turbine to a reheat surface located within the another chamber of the multichambered backpass volume.

19. In a steam generation plant, the method for exercising control over the final predefined superheat outlet steam temperature and for exercising control over the final reheat outlet steam temperature as set forth in claim 18 further comprising the step of condensing the saturated steam from the low pressure turbine to feedwater and thereafter effecting the flow of the feedwater to a first economizer surface located within the one chamber of the multichambered backpass volume and to a second economizer surface located within the another chamber of the multichambered backpass volume.

20. In a steam generation plant, the method for exercising control over the final predefined superheat outlet steam temperature and for exercising control over the final reheat outlet steam temperature as set forth in claim 15 wherein the flow of the separated saturated steam is effected to a low temperature superheat surface located within the one chamber of the multichambered backpass volume, the flow of the superheat steam is effected from the low temperature superheat surface to a finishing superheat surface located within the furnace volume, and the flow of the superheat steam is effected from the high pressure turbine to a low temperature reheat surface located within the another chamber of the multichambered backpass volume, and further comprising the step of effecting the flow of the superheat steam from the low temperature reheat surface to a finishing reheat surface located within the furnace volume.

21. In a steam generation plant, the method for exercising control over the final predefined superheat outlet steam temperature and for exercising control over the final predefined reheat outlet steam temperature as set forth in claim 20 further comprising the step of effecting the condensing of the saturated steam from the low pressure turbine to feedwater and thereafter effecting the flow of the feedwater to a first economizer surface located within the one chamber of the multichambered backpass volume and to a second economizer surface located within the another chamber of the multichambered backpass volume.

* * * * *